US009766562B2

(12) United States Patent
Ishida et al.

(10) Patent No.: US 9,766,562 B2
(45) Date of Patent: Sep. 19, 2017

(54) PHOTOCONDUCTOR, IMAGE FORMING APPARATUS, AND PROCESS CARTRIDGE

(71) Applicants: Toshihiro Ishida, Shizuoka (JP); Eiji Kurimoto, Shizuoka (JP); Tetsuro Suzuki, Shizuoka (JP); Tomoharu Asano, Kanagawa (JP); Daisuke Nii, Shizuoka (JP)

(72) Inventors: Toshihiro Ishida, Shizuoka (JP); Eiji Kurimoto, Shizuoka (JP); Tetsuro Suzuki, Shizuoka (JP); Tomoharu Asano, Kanagawa (JP); Daisuke Nii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/144,199

(22) Filed: May 2, 2016

(65) Prior Publication Data

US 2016/0334720 A1 Nov. 17, 2016

(30) Foreign Application Priority Data

May 13, 2015 (JP) ..... 2015-098281

(51) Int. Cl.
*G03G 5/147* (2006.01)
*G03G 5/14* (2006.01)
*G03G 21/18* (2006.01)

(52) U.S. Cl.
CPC ..... *G03G 5/144* (2013.01); *G03G 5/142* (2013.01); *G03G 5/1476* (2013.01); *G03G 5/14765* (2013.01); *G03G 21/18* (2013.01)

(58) Field of Classification Search
CPC ... G03G 5/144; G03G 5/1476; G03G 5/14765
See application file for complete search history.

(56) References Cited

U.S. PATENT DOCUMENTS 7,153,574 B2 * 12/2006 Qi ..... G03G 5/142 346/135.1
2006/0014093 A1 1/2006 Li et al.
(Continued)

FOREIGN PATENT DOCUMENTS

JP 11-344819 12/1999
JP 2000-275880 10/2000
(Continued)

OTHER PUBLICATIONS

English language machine translation of JP 2005-043392 (Feb. 2005).*
(Continued)

*Primary Examiner* — Christopher Rodee
(74) *Attorney, Agent, or Firm* — Oblon, McClelland, Maier & Neustadt, L.L.P.

(57) ABSTRACT

A photoconductor including: a conductive support; an undercoat layer; and a photoconductive layer, the undercoat layer being disposed over the conductive support, the photoconductive layer being disposed over the undercoat layer, wherein the undercoat layer includes zinc oxide particles, wherein when a film thickness of the undercoat layer is 20 μm, the undercoat layer has transmittance of 50% or more to light having a wavelength in a range of 500 nm or more but 800 nm or less, wherein a lowest transmittance of light is 85% or less in the range, and wherein when an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

16 Claims, 4 Drawing Sheets

(56) References Cited

U.S. PATENT DOCUMENTS

| | | | | |
|---|---|---|---|---|
| 2006/0188798 | A1* | 8/2006 | Tokutake | G03G 5/144 430/60 |
| 2010/0129744 | A1* | 5/2010 | Wu | G03G 5/0539 430/58.8 |
| 2015/0168856 | A1 | 6/2015 | Kurimoto et al. | |
| 2015/0309430 | A1 | 10/2015 | Nii et al. | |
| 2016/0011527 | A1* | 1/2016 | Murakami | G03G 5/0517 430/56 |

FOREIGN PATENT DOCUMENTS

| | | | |
|---|---|---|---|
| JP | 2003-084472 | | 3/2003 |
| JP | 2003-098705 | | 4/2003 |
| JP | 2005043392 | A * | 2/2005 |
| JP | 2007-047467 | | 2/2007 |
| JP | 2007-322996 | | 12/2007 |
| JP | 2008-096527 | | 4/2008 |
| JP | 2008-299020 | | 12/2008 |
| JP | 2009237115 | A * | 10/2009 |

OTHER PUBLICATIONS

English language machine translation of JP 2009-237115 (Oct. 2009).*

* cited by examiner

PHOTOCONDUCTOR, IMAGE FORMING APPARATUS, AND PROCESS CARTRIDGE

CROSS-REFERENCE TO RELATED APPLICATIONS

The present application claims priority under 35 U.S.C. §119 to Japanese Patent Application No. 2015-098281, filed May 13, 2015. The contents of which are incorporated herein by reference in their entirety.

BACKGROUND OF THE INVENTION

Field of the Invention

The present disclosure relates to photoconductors, image forming apparatuses including the photoconductors, and process cartridges including the photoconductors.

Description of the Related Art

In an image forming method using an image forming apparatus, an image is formed by subjecting a photoconductor to, for example, a charging step, an exposure step, a developing step, and a transfer step. Recently, an organic photoconductor containing an organic material is widely used as a photoconductor because of advantages such as flexibility, thermal stability, and film-forming property.

Recently, there is a need for photoconductors to have greater degrees of durability and stability along with rapid advancement in full-color, high-speed, and high-definition properties of image forming apparatuses. Moreover, improvement in a surface layer such as a protective layer drastically improves the photoconductor in wear durability. Meanwhile, there is a need for each layer constituting the photoconductor (e.g., a photoconductive layer, an intermediate layer, and an undercoat layer) to have electric durability, chemical durability, and stability of electric property to fluctuation of usage environment.

An organic material constituting a photoconductor gradually changes in quality through electrostatic load in the typical electrographic process including repetitive charging and charge eliminating. As a result, the photoconductor is deteriorated in electric property, and cannot retain electric stability when the photoconductor is used for a long term. It is known that deterioration in charging property considerably adversely affects quality in output images, and causes serious problems such as deterioration in image quality, background fog (hereinafter may be referred to as background stain, fog, and black spots), poor uniformity of images during continuous outputs. It is believed that these problems are closely related to the undercoat layer of the photoconductor. Therefore, improvement in the undercoat layer is necessary in order to obtain durability and high stability of the photoconductor.

Generally, an organic photoconductor includes a conductive support containing, for example, aluminium, an undercoat layer disposed on the support, and a photoconductive layer disposed on the undercoat layer. The undercoat layer is a conductive layer mainly containing a binder resin and conductive particles such as metal oxide particles, and is disposed in order to achieve three objects: "function of leak resistance", which is obtained by covering the surface of the support with the undercoat layer; "function of preventing injection of charges" from the support to the photoconductive layer; and "function of transporting charges" to the support, where the charges are generated in the photoconductive layer. The undercoat layer is required to improve these functions.

As the typical undercoat layers, proposed is an undercoat layer containing titanium oxide particles (see Japanese Unexamined Patent Application Publication No. 2003-98705). Moreover, proposed is a method for imparting leak resistance to an undercoat layer by disposing an intermediate layer on the undercoat layer (see Japanese Unexamined Patent Application Publication No. 2007-047467).

Additionally, another proposed undercoat layer has a film thickness of 10 μm or less, and contains titanium oxide particles, and zinc oxide particles that are subjected to hydrophobic treatment with a reactive organic silicon compound (see Japanese Unexamined Patent Application Publication No. 2008-299020). Meanwhile, another proposed undercoat layer contains tin oxide particles or zinc oxide particle (see Japanese Unexamined Patent Application Publication No. 2003-084472). Another undercoat layer contains salicylic acid or a thiol-group-containing compound (see Japanese Unexamined Patent Application Publication No. 2008-96527).

Meanwhile, another proposed undercoat layer contains conductive metal oxide particles (zinc oxide particles) that are surface-treated with the silane coupling agent (aminosilane), and when a film thickness of the undercoat layer is 20 μm, transmittance of the undercoat layer to light having 950 nm is 85% or more, and volume resistivity of the undercoat layer is $1\times10^{10}$ Ω·cm or more but $1\times10^{12}$ Ω·cm or less (see Japanese Unexamined Patent Application Publication No. 2007-322996).

None of the above documents of the related art has provided a photoconductor containing an undercoat layer, and having stable electric property even if used for a long term, and being can be prevented from causing an afterimage during image formation and background fog, where the undercoat layer satisfies all of the following functions necessary for the undercoat layer to have: the function of leak resistance, the function of preventing injection of charges, and the function of transporting charges.

SUMMARY OF THE INVENTION

A photoconductor includes a conductive support, an undercoat layer, and a photoconductive layer. The undercoat layer is disposed over the conductive support, and the photoconductive layer is disposed over the undercoat layer. The undercoat layer contains zinc oxide particles. When a film thickness of the undercoat layer is 20 μm, the undercoat layer has transmittance of 50% or more to light having a wavelength in a range of 500 nm or more but 800 nm or less. A lowest transmittance of the undercoat layer to light in the range is 85% or less. When an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

DESCRIPTION OF THE EMBODIMENTS (Photoconductor)

Figure 1:
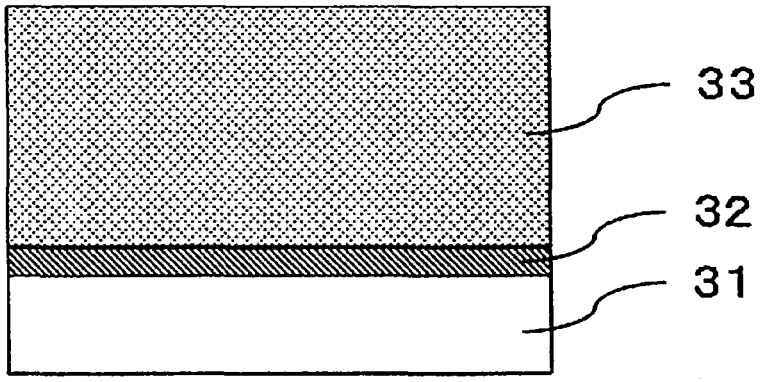
FIG. 1 is a schematic view of one example illustrating a layer configuration of a photoconductor of the present invention.

A photoconductor of the present invention includes a conductive support, an undercoat layer, and a photoconductive layer, where the undercoat layer is disposed over the conductive support, and the photoconductive layer is disposed over the undercoat layer. The photoconductor further includes other layers if necessary.

The photoconductor of the present invention includes the undercoat layer containing materials defined in the present invention. The typically used products can be used for the conductive support, the photoconductive layer, and the other layers.

An object of the present invention is to provide a photoconductor that has little environmental fluctuation and is excellent in stable electric properties even after long-term use of the photoconductor, and that can be prevented from generating background fog during formation of images.

According to the present invention, a photoconductor that is excellent in stable electric properties even after long-term use or under various usage environments, and can be prevented from generating background fog during formation of images can be provided.

<Undercoat Layer>

Generally, the undercoat layer contains metal oxide particles and a binder resin, and further contains other components if necessary.

The undercoat layer of the photoconductor completely covers a conductive support with a homogeneous film (function of leak resistance); prevents injection of unnecessary charges (charges having an opposite polarity to charging polarity of the photoconductor) from the conductive support into the photoconductive layer (function of preventing injection of charges); and transports charges generated in the photoconductive layer, which have the same polarity as charging polarity of the photoconductor (function of transporting charges). In order to obtain a photoconductor having long-term stability, it is important that the aforementioned functions be not changed through repetitive electrostatic load.

As a result of extensive studies for overcoming these problems, the present inventors found that the aforementioned properties can be obtained when the undercoat layer satisfies the following conditions: the undercoat layer contains zinc oxide particles; when a film thickness of the undercoat layer is 20 μm, the undercoat layer has transmittance of 50% or more to light having a wavelength in a range of 500 nm or more but 800 nm or less; a lowest transmittance of light is 85% or less in the range; and when an electric field of 5 V/μm is applied to the undercoat layer, volume resistivity of the undercoat layer is $1.0\times10^7$ Ω·cm or more but $5.0\times10^8$ Ω·cm or less at an environment of 23° C. and 55% RH.

Although it is not clear why the present invention satisfies the functions required for the undercoat layer, the following reasons are conceivable.

Zinc oxide particles are excellent in electric property. It is believed that when an electric field of 5 V/μm is applied to the undercoat layer at an environment of 23° C. and 55% RH, volume resistivity of the undercoat layer is $1.0\times10^7$ Ω·cm or more but $5.0\times10^8$ Ω·cm or less, and thus the undercoat layer becomes excellent in the function of preventing injection of charges and the function of transporting charges. Therefore, stable electric property of the photoconductor can be retained even if the photoconductor is used for a long term under various usage environments.

When the undercoat layer contains zinc oxide particles, the undercoat layer is a film containing the zinc oxide particles uniformly dispersed. It is believed that when a film thickness of the undercoat layer is 20 μm, the undercoat layer has transmittance of 50% or more to light having a wavelength in a range of 500 nm or more but 800 nm or less, and a lowest transmittance of light is 85% or less in the range, which can retain homogeneous dispersibility of the zinc oxide in the coating layer. The undercoat layer contains aggregated zinc oxide particles that cause optical scattering, which prevents transmission of light, and then the aggregated zinc oxide particles become typical leak points. As a result, background fog causing abnormal images may be caused, and the aggregated zinc oxide particles causes charge trap, which results in an increase in residual potential.

However, deterioration of the zinc oxide particles easily occurs due to crack and wearing generated through force applied for dispersion. Thus, it is believed that the zinc oxide particles are deteriorated in electric property, and resistivity of the undercoat layer containing the aforementioned zinc oxide particles becomes high, and thus the undercoat layer cannot retain electric property.

In the preferable embodiment of the present invention, zinc oxide particles that are surface-treated with alkylalkoxysilane are used. Here, at least one alkyl group bound to Si in the alkylalkoxysilane includes at least one alkyl group having 4 or less carbon atoms.

It is believed that when the zinc oxide particles are zinc oxide particles surface-treated with alkylalkoxysilane (at least one alkyl group bound to Si in the alkylalkoxysilane includes at least one alkyl group having 4 or less carbon atoms), the zinc oxide particles can be prevented from deterioration during dispersion of the zinc oxide particles, and can be considerably homogeneously dispersed.

The alkylalkoxysilane (at least one alkyl group bound to Si in the alkylalkoxysilane includes at least one alkyl group having 4 or less carbon atoms) that is strongly bound to zinc oxide particles can prevent zinc oxide particles from deterioration during dispersion, can improve the zinc oxide particles in affinity with organic solvents or binder resins, and can lower aggregation force between zinc oxide particles. As a result, it is believed that the zinc oxide particles are homogeneously dispersed in the undercoat layer, and the undercoat layer can retain excellent electric property and leak resistance property.

In another preferable embodiment of the present invention, the undercoat layer contains a salicylic acid derivative or a thiol compound.

When the undercoat layer contains the thiol-group-containing compound or the salicylic acid derivative, the zinc oxide particles can be homogeneously dispersed in the undercoat layer, and can attain the volume resistivity described above.

<<Zinc Oxide Particles>>

The zinc oxide particles are not particularly limited, and zinc oxide particles that can achieve the object of the present invention can be selected. Moreover, two or more zinc oxide particles having different properties can be used in combination.

<<Method for Preparing Zinc Oxide Particles>>

The typically known methods are used to produce the zinc oxide particles of the present invention, but a so-called wet method is preferably used among them. The wet method is roughly divided into two methods. One method is as follows: an aqueous solution of a zinc compound (typically, zinc salt) such as zinc sulfate or zinc chloride is neutralized with a solution of soda ash, and the thus-generated zinc carbonate is calcined after washed and dried, to obtain the zinc oxide particles. The other method is as follows: zinc hydroxide particles are formed, and then are calcined after washed and dried to obtain the zinc oxide particles. In the case of zinc oxide particles obtained by the aforementioned wet methods, an amount of a specific element can be intentionally changed depending on choice of materials and the production conditions to easily obtain the zinc oxide particles of the present invention.

Details of the wet method will be described below.

Specifically, the wet method includes producing a precipitate from a zinc-containing aqueous solution and an alkaline aqueous solution, aging and washing the precipitate, wetting the precipitate with an alcohol, starting drying the resultant to obtain a zinc oxide particle precursor, and firing the zinc oxide particle precursor to zinc oxide particles. Here, a zinc compound for preparing the zinc-containing aqueous solution is not particularly limited and examples of the zinc compound include zinc nitrate, zinc chloride, zinc acetate, and zinc sulfate. Zinc sulfate is preferable in order for sulfur derived from sulfuric acid to be contained in the zinc oxide used in the present invention.

Examples of the alkaline aqueous solution include aqueous solutions of sodium hydroxide, calcium hydroxide, ammonium hydrogen carbonate, and ammonia. A mixture system of sodium hydroxide, ammonium hydrogen carbonate, and calcium hydroxide is particularly preferable as a method as obtaining the zinc oxide used in the present invention.

A concentration of sodium hydroxide in the alkaline aqueous solution is preferably an excess concentration that is a multiple by a value in a range of from 1.0 time through 1.5 times of a chemical equivalent needed for the zinc compound to become a hydroxide.

This is because a devoted amount of the zinc compound can react when the alkali is more than or equal to the chemical equivalent and a washing time taken for removing residual alkali is short when the excess concentration is less than or equal to a 1.5-times multiple.

Next, production and aging of a precipitate will be described.

The precipitate is produced by dropping an aqueous solution of the zinc compound into an alkaline aqueous solution continuously stirred. Immediately upon the aqueous solution of the zinc compound being dropped into the alkaline aqueous solution, a degree of supersaturation is reached to produce a precipitate. Therefore, a precipitate of fine particles of zinc carbonate and zinc carbonate hydroxide having a uniform particle diameter can be obtained.

It is difficult to obtain the precipitate of fine particles of zinc carbonate and zinc carbonate hydroxide having a uniform particle size as described above by dropping the alkaline solution into the aqueous solution of the zinc compound or by dropping the solution of the zinc compound and the alkaline solution in parallel. A temperature of the alkaline aqueous solution during production of the precipitate is not particularly limited, but is lower than or equal to 50° C., and is preferably room temperature. A lower limit of the temperature of the alkaline aqueous solution is not specified. However, when a temperature of the alkaline aqueous solution is excessively low, a heating device or the like is necessary. Therefore, a temperature at which no such device needs to be used is preferable. A dropping time for dripping the aqueous solution of the zinc compound into the alkaline aqueous solution is shorter than 30 minutes, preferably shorter than or equal to 20 minutes, and further preferably shorter than or equal to 10 minutes in terms of productivity. After dropping is completed, stirring is continued for aging in order to homogenize the system internally. An aging temperature is the same as the temperature during production of the precipitate. A time for which stirring is continued is not particularly limited, but is shorter than or equal to 30 minutes, and preferably shorter than or equal to 15 minutes in terms of productivity.

The precipitate obtained after the aging is washed by decantation. Adjustment of electroconductivity of a washing solution makes it possible to adjust an amount of sulfate ions remaining in the fine particles. Therefore, an amount of sodium, an amount of calcium, and an amount of sulfate in zinc oxide finally obtained can be controlled. Next, the washed precipitate is treated by wetting with an alcohol solution and the wetting-treated product is dried to obtain a zinc oxide particle precursor. The wetting treatment can prevent aggregation of the zinc oxide particle precursor obtained after the drying. An alcohol concentration of the alcohol solution is preferably higher than or equal to 50% by mass. The alcohol concentration of higher than or equal to 50% by mass is preferable because the zinc oxide particles can avoid becoming a strong aggregate and have an excellent dispersibility.

The alcohol solution used in the wetting treatment will be described.

An alcohol used in the alcohol solution is not particularly limited but an alcohol soluble in water and having a boiling point of lower than or equal to 100° C. is preferable. Examples of the alcohol include methanol, ethanol, propanol, and tert-butyl alcohol.

The wetting treatment will be described.

The wetting treatment may be performed by putting the filtrated, washed precipitate into the alcohol solution and stirring the precipitate. Here, a time and a stirring speed may be appropriately selected according to the amount treated. The amount of the alcohol solution into which the precipitate is put may be a liquid amount that enables the precipitate to be stirred easily and can secure liquidity. A stirring time and the stirring speed are appropriately selected on the condition that the precipitate that may have been partially aggregated during the filtering and washing described above be uniformly mixed in the alcohol solution until the aggregation is resolved.

The wetting treatment may typically be performed at normal temperature. However, as needed, the wetting treatment may also be performed while performing heating to a degree until which the alcohol does not evaporate and get lost. It is preferable to perform heating at a temperature lower than or equal to the boiling point of the alcohol. This makes it possible to avoid the alcohol dissipating during the wetting treatment and the wetting treatment being ineffective. Persistence of the presence of the alcohol during the wetting treatment is preferable because the effect of the wetting treatment can be obtained and the precipitate does not become a strong aggregate after dried.

The method for drying the wetting-treated product will be described.

Drying conditions such as a drying temperature and a time are not particularly limited and heating drying may be started in the state that the wetting-treated product is wet with the alcohol. The precipitate does not become a strong aggregate even when heating-dried so long as the heating drying is performed after the wetting treatment. Therefore, drying conditions may be appropriately selected depending on the amount of the wetting-treated product treated, a treating apparatus, etc.

Through the drying treatment, a zinc oxide particle precursor that has undergone the wetting treatment can be obtained. The precursor is fired to become zinc oxide particles. The firing of the zinc oxide precursor that has undergone the drying treatment is performed under an atmosphere of an inert gas such as atmospheric air, nitrogen, argon, and helium or an atmosphere of a mixed gas between the inert gas described above and a reducing gas such as hydrogen. Here, a lower limit of a treating temperature is preferably around 400° C. in terms of a desired ultraviolet absorbing (shielding) property. A treating time is appropriately selected depending on the amount of the zinc oxide precursor treated and a firing temperature.

—Average Particle Diameter of Zinc Oxide Particles—

A particle diameter (volume average particle diameter) of the zinc oxide particles can be appropriately selected depending on the intended purpose, but an average particle diameter is 20 nm or more but 200 nm or less, more preferably 50 nm or more but 150 nm or less. When the average particle diameter is less than 20 nm, it may be difficult to form a film of the undercoat layer having an excellent dispersibility. When it is more than 200 nm, it may be difficult to retain excellent electric property of the undercoat layer.

An average primary particle diameter of the zinc oxide particles is determined as follows: 100 particles in the undercoat layer are observed using a transmission electron microscope (TEM); a projected area of each of the particles is determined; each of the projected area diameters of the obtained areas is calculated to determine a volume average particle diameter; and the volume average particle diameter is determined as an average particle diameter.

—Volume Rate of Zinc Oxide Particles Occupying Undercoat Layer—

A volume rate of the zinc oxide particles occupying the undercoat layer is not particularly limited and may be appropriately selected depending on the intended purpose, but it is preferably 40% or more but 55% or less, more preferably 45% or more but 53% or less of the undercoat layer. When the volume rate of the zinc oxide particles occupying the undercoat layer is 40% or more, the volume resistivity of the undercoat layer does not become too high, and thus the undercoat layer can retain excellent electric property. When the volume rate of the zinc oxide particles occupying the undercoat layer is 55% or less, the film of the undercoat layer has high transmittance and good dispersibility, and thus background fog resistance can be sufficiently obtained.

An occupancy volume of the zinc oxide can be calculated based on an amount to be charged and a specific gravity of the zinc oxide, an amount to be charged and a specific gravity of the resin components, and an amount to be charged and a specific gravity of other components added.

<<Surface Treating Agent>>

A surface treating agent for surface-treating the zinc oxide particles is alkylalkoxysilane. Here, at least one alkyl group bound to Si in the alkylalkoxysilane is at least one alkyl group having 4 or less carbon atoms. As a result, it is believed that the zinc oxide particles can be prevented from deterioration during dispersion, and are dispersed in the undercoat layer in a state of being considerably homogeneously dispersed. Examples of the surface treating agent include methyltrimethoxysilane, dimethyldimethoxysilane, trimethylmethoxysilane, methyltriphenoxysilane, ethyltrimethoxysilane, n-propyltrimethoxysilane, diisopropyldimethoxysilane, isobutyltrimethoxysilane, diisobutyldimethoxysilane, methyltriethoxysilane, dimethyldiethoxysilane, and n-propyltriethoxysilane. These may be used alone or in combination thereof.

When the surface treating agent for surface-treating the zinc oxide particles is alkylalkoxysilane (at least one alkyl group bound to Si in the alkylalkoxysilane is at least one alkyl group having 5 or more carbon atoms), aggregation between particles of the surface treating agent is high, and the zinc oxide particles are difficult to disperse. Moreover, a length of the alkyl chain is long, and thus steric hindrance of the surface treating agent arises. Thus, an amount of the surface treating agent on the zinc oxide particles is insufficient. As a result, the dispersibility and the electric property of the zinc oxide particles cannot be achieved at the same time.

Moreover, another surface treating agent may be used in combination with alkylalkoxysilane (at least one alkyl group bound to Si in the alkylalkoxysilane includes at least one alkyl group having 4 or less carbon atoms). The another surface treating agent is not particularly limited and may be appropriately selected depending on the intended purpose. Examples of the another surface treating agent include vinyltrimethoxysilane, γ-methacryloyloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilan. These may be used alone or in combination thereof.

A method for treating the zinc oxide particles with the surface treating agent is not particularly limited and may be appropriately selected depending on the intended purpose. Examples of the method include a dry method and a wet method.

—Dry Method—

Examples of the dry method include a dry method for uniformly treating the zinc oxide particles as described below. The surface treating agent is directly added dropwise to the zinc oxide particles, or while stirring these materials by a mixer having a high shearing force, the surface treating agent dissolved in an organic solvent is added dropwise to the zinc oxide, to be sprayed with dry air or nitrogen gas. It is preferable that the surface treating agent be added dropwise and sprayed at a temperature lower than a boiling point of the organic solvent. When the surface treating agent is sprayed at a temperature higher than the boiling point of the organic solvent, the organic solvent is volatilized before uniformly stirred. As a result, the surface treating agent is locally aggregated, and thus uniformly surface-treated zinc oxide particles may not be obtained. The surface treating agent is added dropwise and then sprayed, and then can be further baked at 100° C. or more. The baking temperature and time are not particularly limited and may be appropriately selected depending on the intended purpose, so long as desired electrophotographic properties can be obtained.

—Wet Method—

The wet method for treating the zinc oxide particles is as follows. Specifically, the zinc oxide particles are dispersed in a solvent through, for example, stirring, ultrasonic wave, a sand-mill, an attritor, or a ball-mill. Next, the surface treating agent is added thereto, and the resultant mixture is stirred or dispersed. Then, the organic solvent is removed to uniformly treat the zinc oxide particles. Examples of methods for removing the solvent include filtration and distillation. After removal of the solvent, baking can be performed at 100° C. or more. A temperature and a time of the baking are not particularly limited and may be appropriately selected so long as predetermined electrophotographic properties can be obtained. In the wet method, water components contained in the zinc oxide particles can be removed before addition of the surface treating agent. Examples of method for removing the water contained in the zinc oxide particles include a method for removing the water components through stirring and heating in the solvent used for surface treatment; and a method for removing water through azeotropy with the solvent.

By surface analysis methods such as photoelectron spectroscopy (ESCA), Auger electron spectroscopy, time-of-flight secondary ion mass spectrometry (TOF-SIMS), and Fourier-transform infrared spectroscopy (FT-IR), it can be confirmed that the surfaces of the zinc oxide particles are coated with the surface treating agent.

<<Thiol-Group-Containing Compound (May be Referred to as "Thiol Compound")>>

Examples of the thiol-containing compounds include ethanethiol, 1-propanethiol, 2-propanethiol, 2-mercaptoethanol, 1-butanthiol, 2-butanthiol, 2-methyl-1-propanethiol, 2-methyl-2-propanethiol, 1,2-ethanedithiol, cyclopentanethiol, 3-methyl-1-butanthiol, 2-methyl-1-butanthiol, 3-methyl-2-butanthiol, 1-pentanethiol, 1,3-propanedithiol, 1,2-propanedithiol, 1-hexanethiol, 1-heptanethiol, 1,5-pentanedithiol, 2-ethyl-1-hexanethiol, tert-octanethiol, 1,6-hexanedithiol, 2-propene-1-thiol, thioacetic acid, 2-aminoethanethiol, mercaptoacetic acid, 2-(methylthio)ethanol, 3-mercaptol-propanol, thiolactic acid, 3-mercaptopropionic acid, methyl thioglycolate, 3-mercapto-2-butanol, 3-mercapto-1,2-propanediol, 3-mercapto-2-pentanone, 2-mercapto-3-pentanone, 2,3-dimercapto-1-propanol, 3-mercapto-1-hexanol-6-mercapto-1-hexanol, benzenethiol, 2-pyridinethiol, 4-pyridinethiol, 2-pyrimidinethiol, p-xylenethiol, m-xylene-4-thiol, 2-ethyl-benzenethiol, (4-methylphenyl)methanethiol, 2-methoxybenzenethiol, 1,2-benzenedithiol, toluene-3,4-dithiol, 3-(trimethoxysilyl) propanethiol, 3-(triethoxysilyl)propanethiol, 3-(dimethoxymethylsilyl)-1-propanethiolpentaerythritol tetrakis(3-mercaptobutylate), 1,4-bis(3-mercaptobutyrylox) butane, 1,3,5-tris(3-mercaptobutyryloxethyl)-1,3,5-triazine-2,4,6(1H, 3H, 5H)-trion e, trimethylolpropane tris(3-mercaptobutyrate), and trimethylolethane tris(3-mercaptobutyrate).

<<Salicylic Acid Derivative>>

Examples of the salicylic acid derivatives include salicylic acid, acetylsalicylic acid, 5-acetylsalicylic acid, 3-aminosalicylic acid, 5-acetyl salicylamide, 5-aminosalicylic acid, 4-azidesalicylic acid, benzyl salicylate, salicylic acid 4-tert-butylphenyl, butyl salicylate, salicylic acid 2-carboxyphenyl, 3,5-dinitroacetylsalicylic acid, dithiosalicylic acid, ethyl acetyl salicylate, 2-ethylhexyl salicylate, ethyl 6-methyl salicylate, ethyl salicylate, 5-formylsalicylic acid, 4-(2-hydroxyethoxy)salicylic acid, salicylic acid 2-hydroxyethyl, isoamyl salicylate, isobutyl salicylate, isopropyl salicylate, 3-methoxysalicylic acid, 4-methoxysalicylic acid, 6-methoxysalicylic acid, methyl acetyl salicylate, methyl 5-acetyl salicylate, methyl 5-allyl-3-methoxy salicylate, methyl 5-formyl salicylate, methyl 4-(2-hydroxyethoxy) salicylate, methyl 3-methoxy salicylate, methyl 4-methoxy salicylate, methyl 5-methoxy salicylate, 4-methyl salicylic acid, 5-methylsalicylic acid, methyl thiosalicylate, 3-methyl salicylic acid, 4-methylsalicylic acid, 5-methylsalicylic acid, methyl thiosalicylate, salicylic acid 4-nitrophenyl, 5-nitrosalicylic acid, 4-nitrosalicylic acid, 3-nitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, 3-methoxy-2-methyl naphthoate, phenyl 1,4-dihydroxy-2-naphthoate, and phenyl 1-hydroxy-2-naphthoate.

These may be used alone or in combination thereof.

<Amount of Thiol-Containing Compound, or Salicylic Acid Derivative>

An amount of the thiol-group-containing compound or the salicylic acid derivative is preferably in a range of from 0.3% by mass through 6% by mass, more preferably in a range of from 1.5% by mass through 4.0% by mass, still more preferably in a range of from 1% by mass through 3% by mass, relative to the amount of the zinc oxide particles before treatment. When the amount of the thiol-containing compound or the salicylic acid derivative is 0.3% by mass or more, the undercoat layer can obtain functions derived from the thiol-containing compound or the salicylic acid derivative, which results in good properties. Moreover, the amount of the thiol-containing compound or the salicylic acid derivative is 6% by mass or less relative to the amount of the zinc oxide particles before treatment, the zinc oxide particles are not prevented from dispersion, which results in sufficient properties.

These may be used alone or in combination thereof.

<<Binder Resin>>

The binder resin is not particularly limited and may be appropriately selected depending on the intended purpose. Examples of the binder resin include thermoplastic resins and thermosetting resins. These may be used alone or in combination thereof. Among them, considering that the photoconductive layer, which will be described below, is coated on the undercoat layer, a binder resin high in solvent resistance against common organic solvents is preferable. Examples of the binder resins high in solvent resistance include water-soluble resins (e.g., polyvinyl alcohol, casein, and sodium polyacrylate); alcohol soluble resins (e.g., copolymer nylon and methoxymethylated nylon); and curable resins which form three-dimensional network structures (e.g., polyurethane, a melamine resin, a phenol resin, an alkyd-melamine resin, and an epoxy resin).

<<Other Components>>

The undercoat layer may contain other components in order to improve the undercoat layer in electric property, environmental stability, and image quality.

The other components are not particularly limited and may be appropriately selected depending on the intended purpose. Examples of the other components include electron transporting substances; electron transport pigments such as polycyclic condensate pigments and azo-pigments; silane coupling agents; zirconium chelate compounds; titanium chelate compounds; aluminium chelate compounds; fluorenone compounds; titanium alkoxide compounds; organotitanium compounds; and the below-described antioxidants, plasticizers, lubricants, ultraviolet absorbing agents, and leveling agents. These may be used alone or in combination thereof.

A method for dispersing the zinc oxide particles in the coating liquid for undercoat layer is not particularly limited and may be appropriately selected depending on the intended purpose. Examples of the method include a method for dispersing the zinc oxide particles using, for example, a ball-mill, a sand-mill, a vibrating-mill, a three-roll mill, an attriter, a pressure homogenizer, or ultrasonic dispersion.

A method for coating the undercoat layer is not particularly limited and may be appropriately selected depending on viscosity of the coating liquid and a film thickness of the undercoat layer to be desired. Examples of the method include a dip coating method, a spray coating method, a bead coating method, and a ring coating method.

The coating liquid for undercoat layer is used for coating, and then the coated film may be heated or dried using an oven if necessary. A temperature of drying the undercoat layer is not particularly limited and may be appropriately selected depending on the kind of a solvent contained in the coating liquid for undercoat layer, but it is preferably 80° C. or more but 200° C. or less, more preferably 100° C. or more but 150° C. or less.

<<Average Thickness of Undercoat Layer>>

An average thickness of the undercoat layer is not particularly limited and may be appropriately selected depending on electric property and lifetime of the photoconductor to be produced, but it is preferably in a range of from 7 μm through 30 μm, more preferably in a range of from 10 μm through 25 μm.

When the average thickness of the undercoat layer is 7 μm or more, there do not occur image defects such as background fog, which is caused due to poor charging property, and is caused by flow of charges having polarity opposite to charging polarity on the surface of the photoconductor from the conductive support into photoconductive layer. Meanwhile, the average thickness is 30 μm or less, there do not occur problems such as degradation of an optical attenuating function due to a rise of a residual potential and degradation of repeating stability. As a method for measuring a thickness of the undercoat layer, an eddy-current film thickness meter, a contact thickness meter, a scanning electron microscope, and a transmission electron microscope can be used. The average thickness of the undercoat layer is determined by calculating the average value of thicknesses randomly-selected five points of the undercoat layer.

<<Transmittance of Undercoat Layer>>

A method for measuring transmittance of the undercoat layer is not particularly limited so long as it is one of the typically known measurement methods. For example, ultraviolet rays-visible rays spectroscopy can be used.

When a film thickness of the undercoat layer is converted to 20 μm, the undercoat layer has transmittance of 50% or more to light having a wavelength in a range of 500 nm or more but 800 nm or less, preferably has transmittance of 60% or more to light having a wavelength in the aforementioned range, and the lowest transmittance of light in the aforementioned range is 85% or less. It is more preferable that the undercoat layer have transmittance of 60% or more to light having a wavelength in a range of 500 nm or more, and a lowest transmittance of light in the aforementioned range be 85% or less.

When the transmittance is less than 50%, localized background fog tends to be caused.

This is because the zinc oxide particles in the undercoat layer are insufficiently dispersed, which causes aggregation of the zinc oxide particles to form leak points.

As a result, it is believed that the scattering caused by these aggregations deteriorates the undercoat layer in transmittance.

The lowest transmittance of light in the aforementioned range is more than 85%, the zinc oxide particles are easily deteriorated due to fine to cracks and wearing. As a result, the electric property of the zinc oxide particles is deteriorated, and the obtained undercoat layer has high resistivity, and thus cannot retain electric property.

<<Volume Resistivity of Undercoat Layer>>

As a method for measuring volume resistivity of the undercoat is layer, a gold electrode is formed on the undercoat layer disposed on the conductive support to form a sandwich structure for measurement. The volume resistivity of the undercoat layer is measured at a temperature of 23° C. and a relative humidity of 55% RH. The volume resistivity of the undercoat layer is calculated using voltage and electric current obtained at the time of applying an electric field of 5 V/μm to the undercoat layer.

The thus-determined volume resistivity at a temperature of 23° C. and a relative humidity of 55% RH is preferably $1.0\times10^{7}$ Ω·cm or more but $5.0\times10^{8}$ Ω·cm or less, more preferably $3.0\times10^{7}$ Ω·cm or more but $3.0\times10^{8}$ Ω·cm or less.

When the volume resistivity of the undercoat layer is less than $1.0\times10^{7}$ Ω·cm, background fog tends to be caused. When the volume resistivity of the undercoat layer is more than $5.0\times10^{8}$ Ω·cm, unevenness of image density tends to occur during continuous paper feeding.

<<Environmental Fluctuation of Volume Resistivity of Undercoat Layer>>

Volume resistivity A of the undercoat layer measured at a temperature 10° C. and a relative humidity of 15% RH by the above method and volume resistivity B of the undercoat layer measured at a temperature 30° C. and a relative humidity of 90% RH by the above method preferably satisfy the following relational expression (1), more preferably satisfy the following relational expression (2).

$$0.2<A/B<5 \quad (1)$$

$$0.5<A/B<3 \quad (2)$$

When A/B is 0.2 or less, or more than 5 or more, image unevenness tends to occur when usage environment is changed.

<Photoconductive Layer>

The photoconductive layer may be a laminated photoconductive layer or a single-layer photoconductive layer.

<<Single-Layer Photoconductive Layer>>

The single-layer photoconductive layer is a layer having a function of generating charges and a function of transporting charges.

The single-layer photoconductive layer contains a charge generating substance, a charge transporting substance, and a binder resin, and further contains other components if necessary.

—Charge Generating Substance—

The charge generating substance is not particularly limited and may be appropriately selected depending on the intended purpose. The same substance as used in the laminated photoconductive layer, which will be described hereinafter, can be used for the charge generating substance. An amount of the charge generating substance is not particularly limited and may be appropriately selected depending on the intended purpose, but it is preferably in a range of from 5 parts by mass through 40 parts by mass relative to 100 parts by mass of the binder resin.

—Charge Transporting Substance—

The charge transporting substance is not particularly limited and may be appropriately selected depending on the intended purpose. The same substance as used in the laminated photoconductive layer, which will be described hereinafter, can be used for the charge transporting substance. An amount of the charge transporting substance is not particularly limited and may be appropriately selected depending on the intended purpose, but it is preferably 190 parts by mass or less, more preferably in a range of from 50 parts by mass through 150 parts by mass relative to 100 parts by mass of the binder resin.

—Binder Resin—

The binder resin is not particularly limited and may be appropriately selected depending on the intended purpose. The same binder resin as used in the laminated photoconductive layer, which will be described hereinafter, can be used for the binder resin.

—Other Components—

The other components are not particularly limited and may be appropriately selected depending on the intended purpose. Examples of the other components include: the same low-molecular-weight charge transporting substance as used in the laminated photoconductive layer and the same solvent as used in the laminated photoconductive layer, which will be described hereinafter; an antioxidant; a plasticizer; a lubricant; an ultraviolet absorbing agent; and a leveling agent, which will be described hereinafter.

—Method for Forming Single-Layer Photoconductive Layer—

A method for forming the single-layer photoconductive layer is not particularly limited and may be appropriately selected depending on the intended purpose. Examples of the method include a method in which a coating liquid is coated and dried to form the single-layer photoconductive layer, where the coating liquid is obtained by dissolving or dispersing a charge generating substance, a charge transporting substance, a binder resin, and other components in an appropriate solvent (e.g., tetrahydrofuran, dioxane, dichloroethane, and cyclohexane) using a disperser.

A method for coating the coating liquid is not particularly limited and may be appropriately selected depending on the intended purpose. Examples of the method include a dip coating method, a spray coating method, a bead coating method, and a ring coating method. Moreover, a plasticizer, a leveling agent, and an antioxidant may be added to the coating liquid if necessary.

A thickness of the single-layer photoconductive layer is not particularly limited and may be appropriately selected depending on the intended purpose, but it is preferably in a range of from 5 μm through 25 μm.

<<Laminated Photoconductive Layer>>

The laminated photoconductive layer includes different layers having a function of generating charges and a function of transporting charges, and includes a charge generating layer and a charge transport layer. Note that, typically known materials can be used for the charge generating layer and the charge transport layer.

In the laminated photoconductive layer, the order of lamination of the charge generating layer and the charge transport layer is not particularly limited and may be appropriately selected depending on the intended purpose. Most of the charge generating materials are poor in chemical stability, and may be deteriorated in charge generating efficiency when the charge generating materials are subjected to acidic gas that is a product obtained through discharging around a charging device during an electrophotography forming process. Therefore, it is preferable that the charge transport layer be disposed on the charge generating layer.

—Charge Generating Layer—

The charge generating layer contains a charge generating substance, preferably contains a binder resin, and if necessary further contains other components such as an antioxidant, which will be described hereinafter.

——Charge Generating Substance——

The charge generating substance is not particularly limited and may be appropriately selected depending on the intended purpose.

Examples of the charge generating substance include inorganic materials and organic materials.

———Inorganic Material———

The inorganic material is not particularly limited and may be appropriately selected depending on the intended purpose. Examples of the inorganic material include crystal selenium, amorphous selenium, selenium-tellurium, selenium-tellurium-halogen, selenium-an arsenic compound, and amorphous-silicone (for example, a dangling bond of the inorganic material terminated by a hydrogen atom or a halogen atom; and compounds containing a boron atom or a phosphorus atom are preferable).

———Organic Material———

The organic material is not particularly limited and may be appropriately selected depending on the intended purpose. Examples of the organic material include phthalocyanine pigments (e.g., metal phthalocyanine and metal-free phthalocyanine), azulanium salt pigments, methine squarate pigments, azo pigments having a carbazole skeleton, azo pigments having a triphenylamine skeleton, azo pigments having a diphenylamine skeleton, azo pigments having a dibenzothiophene skeleton, azo pigments having fluorenone skeleton, azo pigments having a oxadiazole skeleton, azo pigments having a bisstilbene skeleton, azo pigments having a distyryloxadiazole skeleton, azo pigments having a distyrylcarbazole skeleton, perylene pigments, anthraquinone or polycyclic quinone pigments, quinoneimine pigments, diphenylmethane and triphenylmethane pigments, benzoquinone and naphthoquinone pigments, cyanine and azomethine pigments, indigoid pigments, and bisbenzimidazole pigments. These may be used alone or in combination thereof.

——Binder Resin——

The binder resin is not particularly limited and may be appropriately selected depending on the intended purpose. Examples of the binder resin include polyamide resins, polyurethane resins, epoxy resins, polyketone resins, polycarbonate resins, silicone resins, acrylic resins, polyvinyl butyral resins, polyvinylformal resins, polyvinylketone resins, polystyrene resins, poly-N-vinylcarbazole resins, and polyacrylamide resins. These may be used alone or in combination thereof.

In addition to the aforementioned binder resins, the binder resin may contain a charge transport polymer material having a function of transporting charges. Examples of the binder resin usable include polycarbonates containing an arylamine skeleton, a benzidine skeleton, a hydrazone skeleton, a carbazole skeleton, a stilbene skeleton, and a pyrazolines skeleton; polymer materials such as polyester, polyurethane, polyether, polysiloxane, and acrylic resins; and polymer materials containing a polysilane skeleton.

——Other Components——

The other components are not particularly limited and may be appropriately selected depending on the intended purpose. Examples of the other components include low-molecular-weight charge transporting substances, solvents, antioxidants, plasticizers, lubricants, ultraviolet absorbing agents, and leveling agents, where the antioxidants, the plasticizers, the lubricants, the ultraviolet absorbing agents, and the leveling agents will be described hereinafter.

An amount of the other components is not particularly limited and may be appropriately selected depending on the intended purpose, but it is preferably in a range of from 0.01% by mass through 10% by mass relative to the total mass of the coating liquid for charge generating layer.

———Low-Molecular-Weight Charge Transporting Substance———

The low-molecular-weight charge transporting substance is not particularly limited and may be appropriately selected depending on the intended purpose. Examples of the low-molecular-weight charge transporting substances include electron transporting substances and hole transporting substances.

The electron transporting substances are not particularly limited and may be appropriately selected depending on the intended purpose. Examples of the electron transporting substances include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide, and diphenoquinone derivatives. These may be used alone or in combination thereof.

The hole transporting substance is not particularly limited and may be appropriately selected depending on the intended purpose. Examples of the hole transporting substance include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazolines derivatives, divinylbenzene derivatives, hydrazone derivatives, indene derivatives, butadiene derivatives, pyrene derivatives, bis-stilbene derivatives, and enamine derivatives. These may be used alone or in combination thereof.

———Solvent———

The solvent is not particularly limited and may be appropriately selected depending on the intended purpose. Examples of the solvent include tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate, and butyl acetate. These may be used alone or in combination thereof.

——Method for Forming Charge Generating Layer——

A method for forming the charge generating layer is not particularly limited and may be appropriately selected depending on the intended purpose. Examples of the method include a method in which the charge generating substance and the binder resin are dissolved or dispersed in other components such as the solvent to obtain a coating liquid; and the coating liquid is coated on the conductive support, followed by drying, to obtain the charge generating layer. Note that, the coating liquid can be coated by a casting method.

A thickness of the charge generating layer is not particularly limited and may be appropriately selected depending on the intended purpose, but it is preferably in a range of from 0.01 μm through 5 μm, more preferably in a range of from 0.05 μm through 2 μm.

—Charge Transport Layer—

The charge transport layer is a layer that retains charges, and transfers charges generated and separated through exposure in the charge generating layer to be combined with the retained charges. In order to achieve the object of retaining the charges, the charge transport layer is required to have high electric resistance. In order that the retained charges obtain high surface potential, the charge transport layer is required to have low permittivity and good electric charge mobility.

The charge transport layer contains a charge transporting substance, preferably contains a binder resin, further contains other components if necessary.

——Charge Transporting Substance——

The charge transporting substance is not particularly limited and may be appropriately selected depending on the intended purpose. Examples of the charge transporting substance include electron transporting substances, hole transporting substances, and polymer charge transporting substances.

An amount of the charge transporting substance relative to the total amount of the charge transport layer is not particularly limited and may be appropriately selected depending on the intended purpose, but it is preferably in a range of from 20% by mass through 90% by mass, more preferably in a range of from 30% by mass through 70% by mass. When the amount thereof is less than 20% by mass, electron transport property of the charge transport layer is lowered, and thus desired optical attenuating property may not be obtained. When the amount thereof is more than 90% by mass, various hazards generated from the image forming step may cause excessive wear of the photoconductor. Meanwhile, the amount of the charge transporting substance in the charge transport layer in the more preferable range is advantageous in that desired optical attenuating property may be obtained, and an electrophotographic photoconductor low in wear through uses can be obtained.

———Electron Transporting Substances———

The electron transporting substances (electron accepting substance) are not particularly limited and may be appropriately selected depending on the intended purpose. Examples of the electron transporting substances include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. These may be used alone or in combination thereof.

———Hole Transporting Substance———

The hole transporting substance (electron donating substance) is not particularly limited and may be appropriately selected depending on the intended purpose. Examples of the hole transporting substance include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These may be used alone or in combination thereof.

———Polymer Charge Transporting Substance———

The polymer charge transporting substance is a material having both of the function of the charge transporting substance and the function of the binder resin, which will be described hereinafter.

The polymer charge transporting substance is not particularly limited and may be appropriately selected depending on the intended purpose. Examples of the polymer charge transporting substance include polymers containing a carbazole ring, polymers containing a hydrazone structure, polysilylene polymers, polymers containing a triarylamine structure (e.g., polymers containing a triarylamine structure disclosed in Japanese Patent No. 3852812 and Japanese Patent No. 3990499), polymers containing an electron donating group, and other polymers. These may be used alone or in combination thereof. The polymer charge transporting substance may be used in combination with the binder resin, in terms of wear durability and film-forming property.

An amount of the polymer charge transporting substance relative to the total amount of the charge transport layer is not particularly limited and may be appropriately selected depending on the intended purpose. When the polymer charge transporting substance is used in combination with the binder resin, the amount of the polymer charge transporting substance and the binder resin is preferably in a range of from 40% by mass through 90% by mass, more preferably in a range of from 50% by mass through 80% by mass.

——Binder Resin——

The binder resin is not particularly limited and may be appropriately selected depending on the intended purpose. Examples of the binder resin include polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinylformal resins, polyacrylate resins, polyacrylamide resins, and phenoxy resins. These may be used alone or in combination thereof.

The charge transport layer may contain a copolymer of a cross-linking binder resin and a cross-linking charge transporting substance.

——Other Components——

The other components are not particularly limited and may be appropriately selected depending on the intended purpose. Examples of the other components include a solvent, an antioxidant, a plasticizer, a lubricant, an ultraviolet absorbing agent, and a leveling agent, where the antioxidant, the plasticizer, the lubricant, the ultraviolet absorbing agent, and the leveling agent will be described hereinafter.

An amount of the other components is not particularly limited and may be appropriately selected depending on the intended purpose, but it is preferably in a range of from 0.01% by mass through 10% by mass relative to the total mass of the coating liquid for charge transport layer.

———Solvent———

The solvent is not particularly limited and may be appropriately selected depending on the intended purpose. The solvent can be the same solvent as used in the preparation of the charge generating layer. However, a solvent that can favorably solve the charge generating layer and the binder resin is preferable. These may be used alone or in combination thereof.

——Method for Forming Charge Transport Layer——

A method for forming the charge transport layer is not particularly limited and may be appropriately selected depending on the intended purpose. Examples the method include a method in which a coating liquid is coated on a charge generating layer, which is heated and dried to form a charge transport layer, where the coating liquid is obtained by dissolving or dispersing the charge transporting substance and the binder resin in the other components (e.g., a solvent).

A method for coating the coating liquid used during formation of the charge transport layer is not particularly limited and may be appropriately selected depending on properties such as viscosity of the coating liquid and a thickness of the charge transport layer desired. Examples of the method include a dip coating method, a spray coating method, a bead coating method, and a ring coating method.

The charge transport layer needs to be heated by any unit to remove the solvent from the charge transport layer in terms of electrophotographic property and viscosity of the film.

Examples of the method for heating the charge transport layer include a method in which air, gas (e.g., nitrogen), vapor, or heat energy (e.g., various heating media, infrared rays, and electromagnetic rays) is used to heat the charge transport layer from a side of the coated surface or a side of the conductive support.

A temperature at which the charge transport layer is heated is not particularly limited and may be appropriately selected depending on the intended purpose, but it is preferably in a range of from 100° C. through 170° C. When the temperature is less than 100° C., the organic solvent in the film cannot be sufficiently removed, which results in deterioration in electrophotographic property and wear durability. Meanwhile, when the temperature is more than 170° C., dents or clacks are generated on the surface and peeling occurs at the interface of the adjacent layer. In addition, desired electric property cannot be obtained when volatile components in the photoconductive layer are dispersed outside.

A thickness of the charge transport layer is not particularly limited and may be appropriately selected depending on the intended purpose, but it is preferably 50 μm or less, more preferably 45 μm or less in terms of resolution and responsiveness. A lower limit of the thickness varies depending on a system to be used (particularly, charge electric potential and the like), but it is preferably 5 μm or more.

<Other Layers>

The other layers are not particularly limited and may be appropriately selected depending on the intended purpose. Examples of the other layers include a protective layer, an intermediate layer, and a second undercoat layer.

<<Protective Layer>>

The protective layer (hereinafter may be referred to as surface layer) can be disposed on the photoconductive layer in order to improve the photoconductor in durability and other functions. The protective layer contains a binder resin and fillers, and further contains other components if necessary.

—Binder Resin—

The binder resin is not particularly limited and may be appropriately selected depending on the intended purpose. Examples of the binder resin include AS resins, ABS resins, ACS resins, olefin-vinyl monomer copolymers, chlorinated polyether resins, allyl resins, phenol resins, polyacetal resins, polyamide resins, polyamide imide resins, polyacrylate resins, polyarylsulfone resins, polybutylene resins, polybutylene terephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, polyurethane resins, polyvinyl chloride resins, polyvinylidene chloride resins, and epoxy resins. These may be used alone or in combination thereof. Among them, polycarbonate resins and polyacrylate resins are preferable in terms of dispersibility of the fillers, and reduction in residual potential and film defect.

—Fillers—

The fillers are not particularly limited and may be appropriately selected depending on the intended purpose. Examples of the fillers include metal oxide fine particles.

The metal oxide fine particles are not particularly limited and may be appropriately selected depending on the intended purpose. Examples of the metal oxide fine particles include aluminium oxide, zinc oxide, titanium oxide, tin oxide, antimony oxide, indium oxide, bismuth oxide, tin-containing indium oxide, tin oxide containing antimony or tantalum, and antimony-containing zirconium oxide. These may be used alone or in combination thereof.

A method for forming the protective layer is not particularly limited and the protective layer can be formed using an appropriate solvent and a coating method as described in the formation of the photoconductive layer. Examples of the method include a dip coating method, a spray coating method, a bead coating method, a nozzle coating method, a spinner coating method, and a ring coating method.

A solvent used in the method for forming the protective layer is not particularly limited and may be appropriately selected depending on the intended purpose. Examples of the solvent include tetrahydrofuran, dioxane, toluene, dichloromethane, monochlorobenzene, dichloroethane, cyclohexanone, methylethylketone, and acetone.

The solvent is preferably high in viscosity during dispersion of the binder resin and the fillers, and that solvent be high in volatility during the coating. When there is no solvent satisfying the aforementioned properties, two or more solvents having the aforementioned properties can be mixed for use, which may result in a large effect on residual potential and dispersibility of the fillers.

It is effective and useful that the charge transporting substance as described for the charge transport layer is added to the protective layer in terms of reduction in residual potential and improvement in image quality.

A thickness of the protective layer is not particularly limited and may be appropriately selected depending on the intended purpose, but it is preferably in a range of from 1 μm through 5 μm in terms of wear resistance.

<<Intermediate Layer>>

The intermediate layer can be disposed between the charge transport layer and the surface layer in order to prevent the surface layer from contamination of the components of the charge transport layer, or in order to improve adhesiveness between the charge transport layer and the surface layer.

The intermediate layer contains a binder resin, and further contains other components such as an antioxidant, which will be described hereinafter, if necessary. The intermediate layer is preferably insoluble or poorly soluble in the coating liquid for surface layer.

The binder resin contained in the intermediate layer is not particularly limited and may be appropriately selected depending on the intended purpose. Examples of the binder resin include polyamide, alcohol-soluble nylon, polyvinyl butyral, and polyvinyl alcohol.

A method for forming the intermediate layer is not particularly limited and may be appropriately selected depending on the intended purpose. The intermediate layer can be formed using the appropriate solvent and the coating method as described in the formation of the photoconductive layer.

A thickness of the intermediate layer is not particularly limited and may be appropriately selected depending on the intended purpose, but it is preferably in a range of from 0.05 μm through 2 μm.

<<Second Undercoat Layer>>

In the photoconductor, the second undercoat layer can be disposed between the conductive support and the undercoat layer, or between the undercoat layer and the photoconductive layer. The second undercoat layer contains a binder resin, further contains other components if necessary.

The binder resin is not particularly limited and may be appropriately selected depending on the intended purpose. Examples of the binder resin include polyamide, an alcohol-soluble nylon, a water-soluble polyvinyl butyral, polyvinyl butyral, and polyvinyl alcohol.

A method for forming the second undercoat layer is not particularly limited and may be appropriately selected depending on the intended purpose. The second undercoat layer can be formed using an appropriate solvent and an appropriate coating method.

A thickness of the second undercoat layer is not particularly limited and may be appropriately selected depending on the intended purpose, but it is preferably in a range of from 0.05 μm through 2 μm.

In order to improve the photoconductor of the present invention in resistance to environment, particularly to prevent the photoconductor of the present invention from reduction in sensitivity and raising residual potential, an antioxidant, a plasticizer, a lubricant, an ultraviolet absorbing agent, and a leveling agent can be added as the other components to each of the layers (e.g., the charge generating layer, the charge transport layer, the undercoat layer, the protective layer, and the second undercoat layer).

The antioxidant is not particularly limited and may be appropriately selected depending on the intended purpose. Examples of the antioxidant include phenol compounds, paraphenylenediamines, hydroquinones, organic sulfur compounds, and organic phosphorus compounds. These may be used alone or in combination thereof.

The plasticizer is not particularly limited and may be appropriately selected depending on the intended purpose. Examples of the plasticizer include plasticizers of the general resins such as dibutyl phthalate and dioctyl phthalate.

The lubricant is not particularly limited and may be appropriately selected depending on the intended purpose. Examples of the lubricant include hydrocarbon compounds, fatty acid compounds, fatty acid amide compounds, ester compounds, alcohol compounds, metal soaps, natural waxes, and other lubricants. These may be used alone or in combination thereof.

The ultraviolet absorbing agent is not particularly limited and may be appropriately selected depending on the intended purpose. Examples of the ultraviolet absorbing agent include benzophenone ultraviolet absorbing agents, salicylate ultraviolet absorbing agents, benzotriazole ultraviolet absorbing agents, cyanoacrylate ultraviolet absorbing agents, quenchers (metal complex salt ultraviolet absorbing agents), and HALS (hindered amines stabilizer). These may be used alone or in combination thereof.

The leveling agent is not particularly limited and may be appropriately selected depending on the intended purpose. Examples of the leveling agent include silicone oils such as dimethyl silicone oils and methylphenyl silicone oils; and polymers or oligomers containing a perfluoroalkyl group at a side chain. These may be used alone or in combination thereof.

<Conductive Support>

The conductive support is not particularly limited and may be appropriately selected depending on the intended purpose, so long as volume resistivity of the conductive support is $1\times10^{10}$ Ω·cm or less. Note that, the endless belts (e.g., endless nickel belt, and endless stainless belt) disclosed in Japanese Examined Patent Publication No. 52-36016 may be used.

A method for forming the conductive support is not particularly limited and may be appropriately selected depending on the intended purpose. The conductive support is formed, by for example, coating a support (e.g., a film-like or cylindrical plastic or paper) with a metal (e.g., aluminium, nickel, chromium, nichrome, copper, gold, silver, and platinum) or a metal oxide (e.g., tin oxide and indium oxide) through sputtering or vapor deposition. Moreover, a plate of metal (e.g., aluminium, alloy of aluminium, nickel, and stainless) can be extruded or drawn out, followed by surface treatment (e.g., after forming an original tube, cutting, super-finishing, and polishing) to form the conductive support.

A conductive layer may be disposed on the conductive support.

A method for forming the conductive layer is not particularly limited and may be appropriately selected depending on the intended purpose. For example, the conductive layer can be formed by coating the conductive support with a coating liquid, where the coating liquid is obtained by dispersing or dissolving conductive powder and a binder resin in a solvent if necessary. Moreover, the conductive layer can be formed by using a thermal shrinkage tube containing the conductive powder in materials (e.g., polyvinyl chloride, polypropylene, polyester, polystyrene, polyvinylidene chloride, polyethylene, chlorinated rubbers, and TEFLON (Registered Trademark)).

The conductive powder is not particularly limited and may be appropriately selected depending on the intended purpose. Examples of the conductive powder include: carbon fine particles (e.g., carbon black and acetylene black); metal powder (e.g., aluminium, nickel, iron, nichrome, copper, zinc, and silver); and metal oxide powder (e.g., conductive tin oxide and ITO).

The binder resin used in the conductive layer is not particularly limited and may be appropriately selected depending on the intended purpose. Examples of the binder resin include thermoplastic resins, thermosetting resins, and photocurable resins. Specific examples of the binder resin include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyallylate resins, phenoxy resins, polycarbonate resins, cellulose acetate resins, ethylcellulose resins, polyvinyl butyral resins, polyvinylformal resins, polyvinyltoluene resins, poly-N-vinylcarbazole, acrylic resins, silicone resins, epoxy resins, melamine resins, urethane resins, phenol resins, and alkyd resins.

A solvent used in the conductive layer is not particularly limited and may be appropriately selected depending on the intended purpose. Examples of the solvent include tetrahydrofuran, dichloromethane, methylethylketone, and toluene.

[Embodiments of Photoconductor]

Embodiments of the photoconductor of the present invention will be described hereinafter.

First Embodiment

A layer configuration of the photoconductor according to a first embodiment will be described with reference to FIG. 1.

FIG. 1 is a structure containing a single-layer photoconductive layer, and is a view illustrating a layer configuration of the photoconductor where an undercoat layer 32 is disposed on a conductive support 31, and a single-layer photoconductive layer 33 is disposed on the undercoat layer 32.

Second Embodiment

A layer configuration of the photoconductor according to a second embodiment will be described with reference to FIG. 2.

Figure 2:
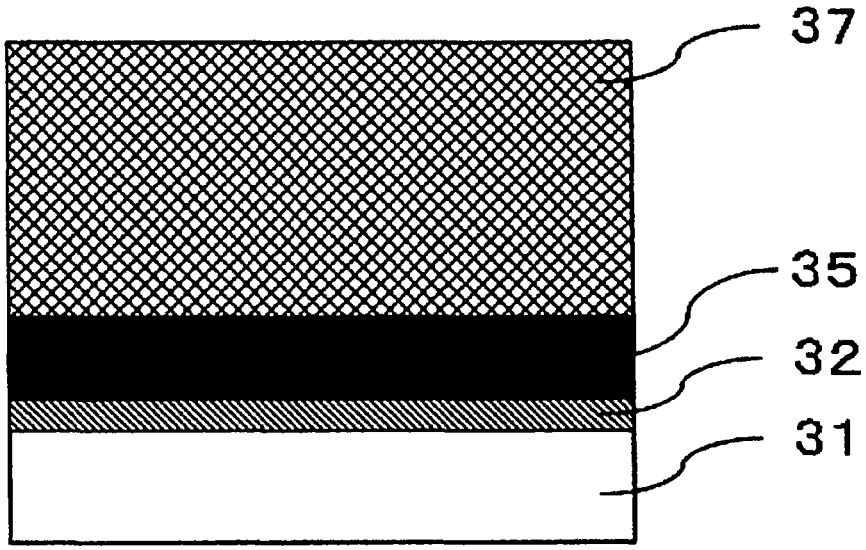
FIG. 2 is a schematic view of one example illustrating a layer configuration of a photoconductor of the present invention.

FIG. 2 is a structure containing a laminated photoconductive layer, and is a view illustrating a layer configuration of the photoconductor where an undercoat layer 32 is disposed on a conductive support 31, a charge generating layer 35 is disposed on the undercoat layer 32, and a charge transport layer 37 is disposed on the charge generating layer 35. Here, the charge generating layer 35 and the charge transport layer 37 correspond to the photoconductive layer.

Third Embodiment

A layer configuration of the photoconductor according to a third embodiment will be described with reference to FIG. 3.

Figure 3:
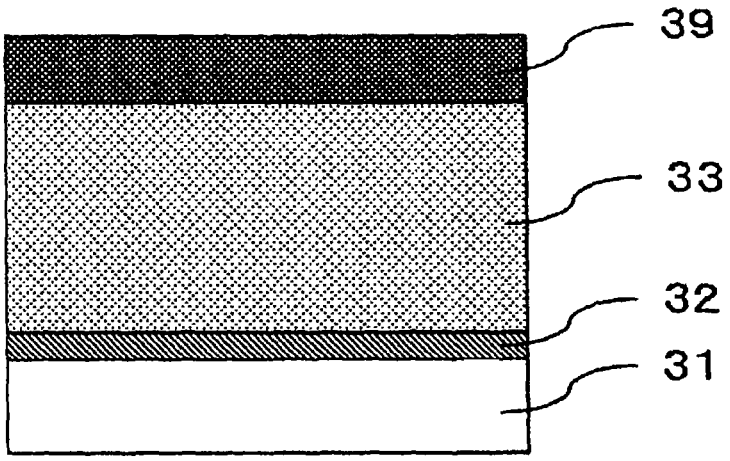
FIG. 3 is a schematic view of one example illustrating a layer configuration of a photoconductor of the present invention.

FIG. 3 is a structure containing a single-layer photoconductive layer, and is a view illustrating a layer configuration of the photoconductor where an undercoat layer 32 is disposed on the conductive support 31, the photoconductive layer 33 is disposed on the undercoat layer 32, and a protective layer 39 is disposed on the photoconductive layer 33.

Fourth Embodiment

A layer configuration of the photoconductor according to a fourth embodiment will be described with reference to FIG. 4.

Figure 4:
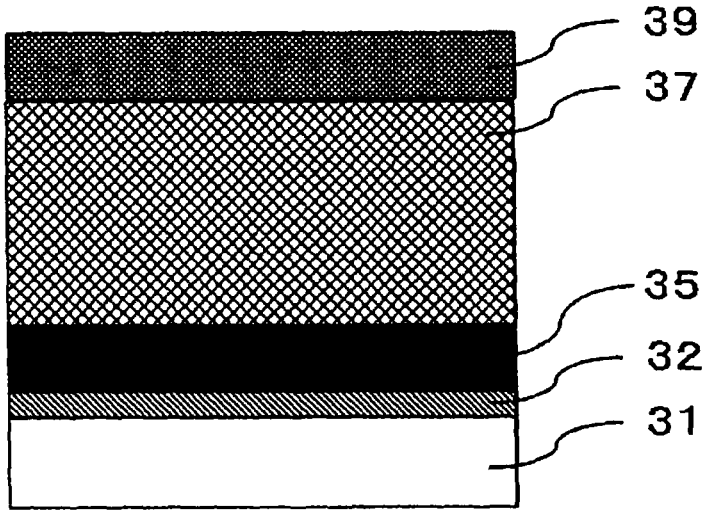
FIG. 4 is a schematic view of one example illustrating a layer configuration of a photoconductor of the present invention.

FIG. 4 is a structure containing a laminated photoconductive layer, and is a view illustrating a layer configuration of the photoconductor where an undercoat layer 32 is disposed on a conductive support 31, a charge generating layer 35 is disposed on the undercoat layer 32, the charge transport layer 37 is disposed on the charge generating layer 35, and a protective layer 39 is disposed on the charge transport layer 37. Note that, the charge generating layer 35 and the charge transport layer 37 correspond to the photoconductive layer.

(Image Forming Apparatus)

An image forming apparatus of the present invention includes: a photoconductor; a charging unit configured to charge a surface of the photoconductor; an exposing unit configured to expose the surface of the photoconductor charged to form an electrostatic latent image; a developing unit configured to develop the electrostatic latent image with a toner to form a visible image; and a transfer unit configured to transfer the visible image onto a recording medium, and further includes other units if necessary. The aforementioned photoconductor of the present invention is used as the photoconductor in the image forming apparatus. Here, the charging unit and the exposing unit may be collectively referred to as an electrostatic latent image forming unit.

[Embodiment of Image Forming Apparatus]

Hereinafter, one embodiment of the image forming apparatus of the present invention will be described with reference to the following example.

Figure 5:
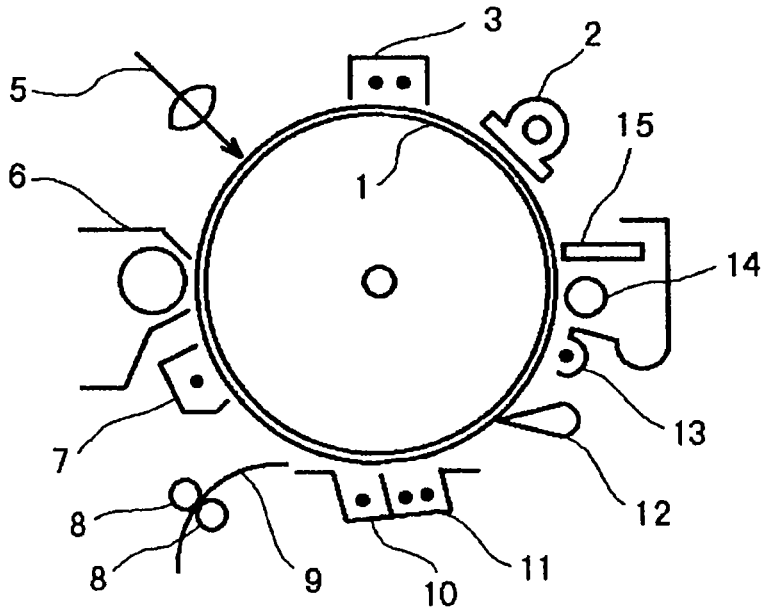
FIG. 5 is a schematic view of one example illustrating an image forming apparatus of the present invention.

FIG. 5 is a schematic view illustrating an image forming apparatus of the present invention. A charging unit 3, an exposing unit 5, a developing unit 6, and a transfer unit 10 are disposed around a photoconductor 1. First, the charging unit 3 uniformly charges the photoconductor 1. As the charging unit 3, for example, a corotron device, a scorotron device, a solid-state discharging element, a multi-stylus electrode, a roller charging device, and a conductive brush device are used, and typically known systems can be used.

Next, an electrostatic latent image is formed on the uniformly charged photoconductor 1 by the exposing unit 5. Examples of a light source used in the exposing unit include general luminescent products such as a fluorescent lamp, a tungsten lamp, a halogen lamp, a mercury lamp, a sodium-vapor lamp, a light-emitting diode (LED), a laser diode (LD), and electroluminescence (EL). In order to emit light having a predetermined wavelength, various filters such as a sharp cut filter, a band pass filter, a near infrared cut filter, a dichroic filter, an interference filter, and a color conversion filter can be used.

Then, the electrostatic latent image formed on the photoconductor 1 is visualized by the developing unit 6. Examples of a developing system used include a one-component development method using a dry toner, a two-component development method, and a wet developing method using a wet toner. The photoconductor 1 is subjected to positive (negative) charging, and then is imagewise exposed to light to form a positively (negatively)-charged electrostatic latent image on the surface of the photoconductor. This electrostatic latent image is developed with a toner (voltage-detecting particles) having negative (positive) polarity to obtain a positive image. Moreover, the latent image is developed with a toner having positive (negative) polarity to obtain a negative image.

Next, the toner image visualized on the photoconductor 1 is transferred onto a recording medium 9 by the transfer unit 10. Moreover, in order for the toner image to be favorably transferred, a pre-transfer charger 7 may be used. As the transfer unit 10, an electrostatic transfer system using a transfer charger or a bias roller; a mechanical transfer system (e.g., an adhesive transfer method and a pressure transfer method); and a magnetic transfer system can be used.

A separation charger 11 and a separation claw 12 may be used as a unit configured to separate the recording medium 9 from the photoconductor 1 if necessary. As other separating units, electrostatic attraction induced separation, side-edge belt separation, tip-grip conveyance, and self stripping are used. As the separation charger 11, the charging unit can be used. In order to clean the toner remaining on the photoconductor after the image is transferred, a cleaning unit such as a fur brush 14 and a cleaning blade 15 is used. A pre-cleaning charger 13 may be used in order to effectively perform the cleaning. Examples of other cleaning units include a web method and a magnetic brush method. These may be used alone or two or more systems may be used together. A charge-eliminating unit 2 may be used for removing a latent image on the photoconductor 1. Examples of the charge-eliminating unit 2 include a charge-eliminating lamp and a charge-eliminating charger. The exposure light source and the charging unit can be used. As the typically known processes, other processes (e.g. scanning manuscripts, feeding sheets of paper, fixing, and paper ejection, where each of the processes is not adjacent to the photoconductor) can be used.

(Process Cartridge)

A process cartridge of the present invention includes a photoconductor; and at least one unit selected from the group consisting of a charging unit, an exposing unit, a developing unit, and a transfer unit, where the charging unit is configured to charge a surface of the photoconductor, the exposing unit is configured to expose the surface of the photoconductor charged to form an electrostatic latent image, the developing unit is configured to develop the electrostatic latent image with a toner to form a visible image, and the transfer unit is configured to transfer the visible image onto a recording medium, and further includes others unit if necessary.

The photoconductor used in the process cartridge of the present invention is the photoconductor of the present invention as described above.

Figure 6:
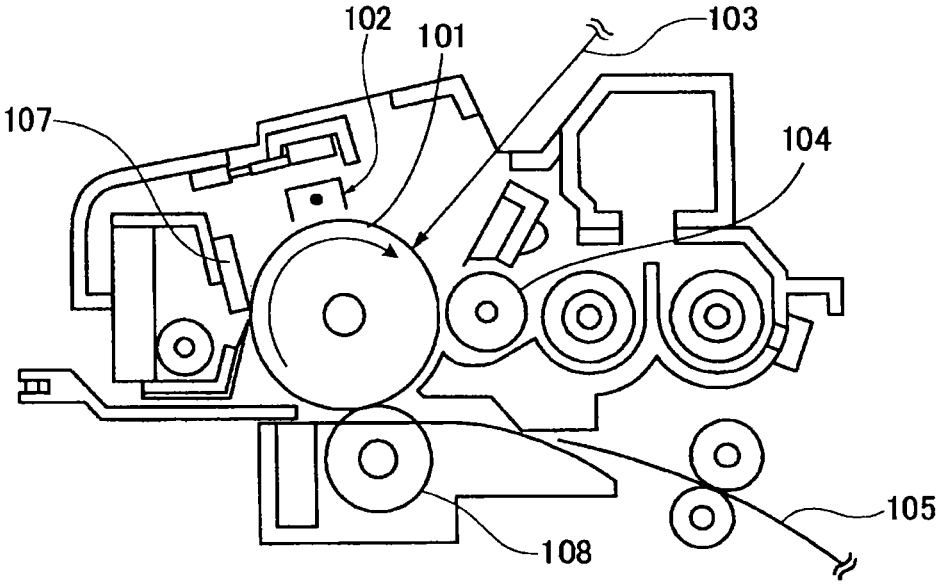
FIG. 6 is a schematic view of one example illustrating a process cartridge of the present invention.

As described in FIG. 6, the process cartridge includes a photoconductor 101 and at least one selected from the group consisting of a charging unit 102, a developing unit 104, a transfer unit 106, a cleaning unit 107, and a charge-eliminating unit. The process cartridge is a device (component) that is detachably mounted on a main body of the image forming apparatus. FIG. 6 illustrates an image forming step by a process cartridge. The photoconductor 101 is subjected to charging by the charging unit 102 and is subjected to exposure by the exposing unit 103 while rotated in the direction indicated by the arrow. Then, the electrostatic latent image, which corresponds to an exposure image, is formed on the surface of the photoconductor 101. This electrostatic latent image is developed with the toner by the developing unit 104 to form a developed image. The developed image is transferred onto a recording medium 105 by the transfer unit 106 to be printed out. Then, after the image is transferred, the surface of the photoconductor is cleaned by the cleaning unit 107, and is further charge-eliminated by the charge-eliminating unit. The above procedures are repeated.

EXAMPLES

The present invention will be described in detail with reference to the following Examples and Comparative Examples. However, it is noted that the present invention is not limited to these Examples. Here, the unit "part(s)" used in Examples means "part(s) by mass".

(1) First, as the zinc oxide particles, Examples using zinc oxide particles that are surface-treated with alkylalkoxysilane (at least one alkyl group bound to Si in the alkylalkoxysilane is at least one alkyl group having 4 or less carbon atoms) will be described hereinafter.

Preparation of Coating Liquid for Undercoat Layer

Preparation Example 1-1

Preparation of Surface-Treated Zinc Oxide 1-1

Zinc oxide particles having an average primary particle diameter of 50 nm, which had been prepared by the aforementioned wet method, were used to treat the surface of the zinc oxide as described below.

The following materials were mixed together and the resultant mixture was stirred for 2 hours. Then, toluene was removed through the reduced-pressure distillation, and the surfaces of the zinc oxide particles were baked at 120° C. for 3 hours to obtain surface-treated zinc oxide particles 1-1.

| | |
|---|---|
| Zinc oxide particles: | 200 parts |
| Surface treating agent: methyltrimethoxysilane (Z-6366, available from Dow Corning Toray Co., Ltd.) | 6 parts |
| Solvent: toluene | 1,000 parts |

<Preparation of Coating Liquid for Undercoat Layer 1-1>

The following materials were mixed together and were stirred using zirconia beads having a diameter of 0.5 mm and a vibration-mill at 1,500 rpm for 24 hours to prepare coating liquid for undercoat layer 1-1.

| | |
|---|---|
| Surface-treated zinc oxide particles 1-1: | 100 parts |
| Binder resin: | |
| Blocked isocyanate (SUMIDUR 3175 (solid concentration: 75%), available from Sumitomo Bayer Urethane Co., Ltd.)) | 13 parts |
| 20% by mass solution obtained by dissolving a butyral resin in 2-butanone (butyral resin: BM-1, available from SEKISUI CHEMICAL CO., LTD.) | 50 parts |
| Solvent: 2-butanone | 120 parts |

Preparation Example 1-2 to Preparation Example 1-16

Preparation of Surface-Treated Zinc Oxides 1-2 to 1-16

Surface-treated zinc oxides 1-2 to 1-16 were prepared in the same manner as in the <Preparation of surface-treated zinc oxide 1-1> in Preparation Example 1-1 except that the surface treating agent and an amount of the surface treating agent used were changed as described in Table 1-1.

<Preparation of Coating Liquids for Undercoat Layer 1-2 to 1-16>

Coating liquids for undercoat layer 1-2 to 1-16 were obtained in the same manner as in the <Preparation of coating liquid for undercoat layer 1-1> except that the surface-treated zinc oxide 1-1 was changed to each of the surface-treated zinc oxides presented in Table 1-1, and that an amount of each component in the binder resins was changed as presented in Table 1-1.

Kinds of the surface-treated zinc oxides, kinds of the surface treating agents, an amount of each component in the binder resin in the coating liquid for undercoat layer are presented in Table 1-1.

TABLE 1-1

| Coating liquid for undercoat layer | | | | | |
|---|---|---|---|---|---|
| | Surface-treated zinc oxide | | | Binder resin | |
| | | Surface treating agent of zinc oxide | | Blocked isocyanate (SUMIDUR 3175) | Butyral resin (BM-1) dissolving solution |
| Coating liquid No. | Zinc oxide No. | Compound | Parts | (Parts) | (parts) |
| Coating liquid for undercoat layer 1-1 | Zinc oxide 1-1 | Methyltrimethoxysilane | 6 | 13 | 50 |
| Coating liquid for undercoat layer 1-2 | Zinc oxide 1-2 | Ethyltrimethoxysilane | 6 | 15 | 56 |
| Coating liquid for undercoat layer 1-3 | Zinc oxide 1-3 | n-Propyltrimethoxysilane | 6 | 15 | 56 |
| Coating liquid for undercoat layer 1-4 | Zinc oxide 1-4 | Isobutyltrimethoxysilane | 8 | 17 | 63 |
| Coating liquid for undercoat layer 1-5 | Zinc oxide 1-5 | Methyltrimethoxysilane | 8 | 17 | 63 |
| Coating liquid for undercoat layer 1-6 | Zinc oxide 1-6 | Methyltrimethoxysilane | 10 | 17 | 63 |
| Coating liquid for undercoat layer 1-7 | Zinc oxide 1-7 | Methyltrimethoxysilane | 2 | 13 | 50 |
| Coating liquid for undercoat layer 1-8 | Zinc oxide 1-8 | Methyltrimethoxysilane | 4 | 22 | 83 |
| Coating liquid for undercoat layer 1-9 | Zinc oxide 1-9 | Methyltrimethoxysilane | 3 | 13 | 50 |
| Coating liquid for undercoat layer 1-10 | Zinc oxide 1-10 | Methyltrimethoxysilane | 2 | 19 | 71 |
| Coating liquid for undercoat layer 1-11 | Zinc oxide 1-11 | Methyltrimethoxysilane | 10 | 19 | 71 |
| Coating liquid for undercoat layer 1-12 | Zinc oxide 1-12 | Methyltrimethoxysilane | 6 | 13 | 50 |
| Coating liquid for undercoat layer 1-13 | Zinc oxide 1-13 | Methyltrimethoxysilane | 6 | 13 | 50 |
| Coating liquid for undercoat layer 1-14 | Zinc oxide 1-14 | Isobutyltrimethoxysilane | 2 | 17 | 63 |
| Coating liquid for undercoat layer 1-15 | Zinc oxide 1-15 | n-Propyltrimethoxysilane | 3 | 17 | 63 |
| Coating liquid for undercoat layer 1-16 | Zinc oxide 1-16 | 3-(2-Aminoethyl)amino propyltrimethoxysilane | 3 | 17 | 63 |

[Preparation of Coating Liquid B for Charge Generating Layer]

Coating liquid B for charge generating layer was prepared in the following manner.

The following materials were mixed together and were stirred using glass beads having a diameter of 1 mm and a bead-mill for 8 hours to prepare coating liquid B for charge generating layer.

| | |
|---|---|
| Charge generating substance: titanyl phthalocyanine | 8 parts |
| Binder resin: polyvinyl butyral (S-LEC BX-1, available from SEKISUI CHEMICAL CO., LTD.) | 5 parts |
| Solvent: 2-butanone | 400 parts |

Figure 7:
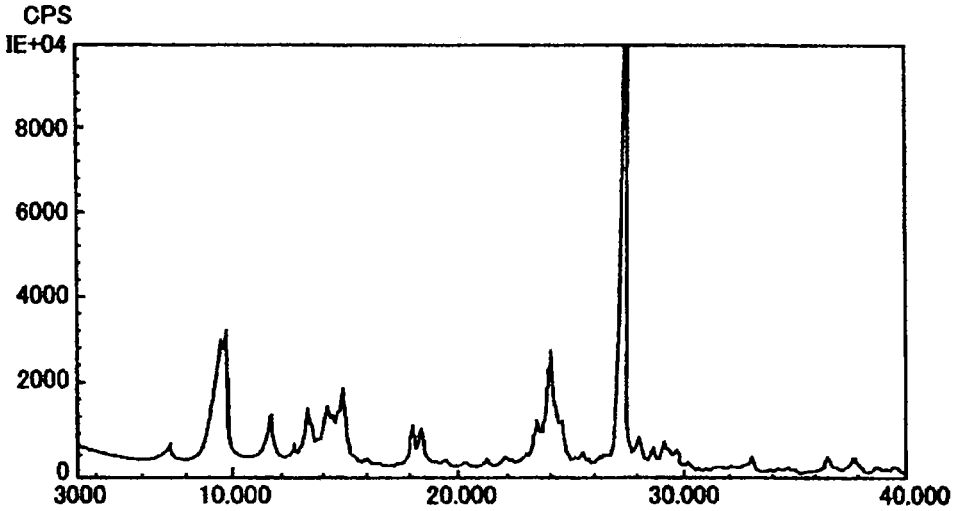
FIG. 7 is a graph of an X-ray diffraction spectrum of titanyl phthalocyanine used as a charge generating substance in Examples.

FIG. 7 is a powder X-ray diffraction spectrum of the titanyl phthalocyanine.

[Preparation of Coating Liquid C for Charge Transport Layer]

A coating liquid for charge transport layer was prepared in the following manner.

The following materials were mixed together and were stirred so as to dissolve all of the materials, to prepare coating liquid C for charge transport layer.

| | |
|---|---|
| Charge transporting substance: charge transporting substance expressed by the following Structural Formula (1) | 7 parts |
| Binder resin: polycarbonate (TS-2050, available from Teijin Chemicals Ltd.) | 10 parts |
| Leveling agent: silicone oil (KF-50, available from Shin-Etsu Chemical Co., Ltd.) | 0.0005 parts |
| Solvent: tetrahydrofuran | 100 parts |

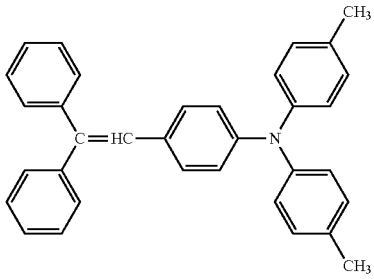

Structural Formula (1)

Example 1-1

An aluminium cylinder (diameter: 100 mm, length: 380 mm) was coated with the coating liquid for undercoat layer 1-1 by the dip coating method, and was dried at 170° C. for 30 minutes to form an undercoat layer having an average thickness of 7 μm. Next, the coating liquid B for charge generating layer was coated on the undercoat layer by the dip coating method, and was dried at 90° C. for 30 minutes to form a charge generating layer having an average thickness of 0.2 μm. Furthermore, the coating liquid C for charge transport layer was coated on the charge generating layer by the dip coating method, and was dried at 150° C. for 30 minutes to form a charge transport layer having an average thickness of 25 μm. As described above, photoconductor 1-1 of Example 1-1 was prepared.

Example 1-2 to Example 1-13

Photoconductors 1-2 to 1-13 of Examples 1-2 to 1-13 were prepared in the same manner as in Example 1-1 except that the coating liquid for undercoat layer 1-1 was changed to each of the coating liquids for undercoat layer 1-2 to 1-13.

Comparative Example 1-1 to Comparative Example 1-3

Photoconductors 1-14 to 1-16 of Comparative Example 1-1 to Comparative Example 1-3 were prepared in the same manner as in Example 1-1 except that the coating liquid for undercoat layer 1-1 was changed to each of the coating liquids for undercoat layer 1-14 to 1-16.

Table 1-2-1 and Table 1-2-2 present kinds of the coating liquids for undercoat layer and thicknesses of the undercoat layers used in Examples and Comparative Examples.

TABLE 1-2-1

| | | | Coating liquid for undercoat layer | | | | |
|---|---|---|---|---|---|---|---|
| | | | | | | Binder resin | |
| | Photoconductor | Film thickness of undercoat | Coating liquid | Surface treatment agent of zinc oxide | | Blocked isocyanate (SUMIDUR 3175) | Butyral resin (BM-1) dissolving |
| | No. | layer (μm) | No. | Compound | Parts | (parts) | solution (parts) |
| Example 1-1 | Photoconductor 1-1 | 7 | Coating liquid for undercoat layer 1-1 | Methyltrimethoxysilane | 6 | 13 | 50 |
| Example 1-2 | Photoconductor 1-2 | 15 | Coating liquid for undercoat layer 1-2 | Ethyltrimethoxysilane | 6 | 15 | 56 |
| Example 1-3 | Photoconductor 1-3 | 25 | Coating liquid for undercoat layer 1-3 | n-Propyltrimethoxysilane | 6 | 15 | 56 |
| Example 1-4 | Photoconductor 1-4 | 30 | Coating liquid for undercoat layer 1-4 | Isobutyltrimethoxysilane | 8 | 17 | 63 |
| Example 1-5 | Photoconductor 1-5 | 20 | Coating liquid for undercoat layer 1-5 | Methyltrimethoxysilane | 8 | 17 | 63 |
| Example 1-6 | Photoconductor 1-6 | 20 | Coating liquid for undercoat layer 1-6 | Methyltrimethoxysilane | 10 | 17 | 63 |
| Example 1-7 | Photoconductor 1-7 | 20 | Coating liquid for undercoat layer 1-7 | Methyltrimethoxysilane | 2 | 13 | 50 |
| Example 1-8 | Photoconductor 1-8 | 20 | Coating liquid for undercoat layer 1-8 | Methyltrimethoxysilane | 4 | 22 | 83 |
| Example 1-9 | Photoconductor 1-9 | 20 | Coating liquid for undercoat layer 1-9 | Methyltrimethoxysilane | 3 | 13 | 50 |
| Example 1-10 | Photoconductor 1-10 | 20 | Coating liquid for undercoat layer 1-10 | Methyltrimethoxysilane | 2 | 19 | 71 |
| Example 1-11 | Photoconductor 1-11 | 20 | Coating liquid for undercoat layer 1-11 | Methyltrimethoxysilane | 10 | 19 | 71 |

TABLE 1-2-2

| | Photoconductor No. | Film thickness of undercoat layer (μm) | Coating liquid for undercoat layer: Coating liquid No. | Surface treatment agent of zinc oxide: Compound | Surface treatment agent of zinc oxide: Parts | Binder resin: Blocked isocyanate (SUMIDUR 3175) (parts) | Binder resin: Butyral resin (BM-1) dissolving solution (parts) |
|---|---|---|---|---|---|---|---|
| Example 1-12 | Photoconductor 1-12 | 5 | Coating liquid for undercoat layer 1-12 | Methyltrimethoxysilane | 6 | 13 | 50 |
| Example 1-13 | Photoconductor 1-13 | 35 | Coating liquid for undercoat layer 1-13 | Methyltrimethoxysilane | 6 | 13 | 50 |
| Comparative Example 1-1 | Photoconductor 1-14 | 20 | Coating liquid for undercoat layer 1-14 | Isobutyltrimethoxysilane | 2 | 17 | 63 |
| Comparative Example 1-2 | Photoconductor 1-15 | 20 | Coating liquid for undercoat layer 1-15 | n-Propyltrimethoxysilane | 3 | 17 | 63 |
| Comparative Example 1-3 | Photoconductor 1-16 | 20 | Coating liquid for undercoat layer 1-16 | 3-(2-Aminoethyl)amino propyltrimethoxysilane | 3 | 17 | 63 |

Evaluation results of a film thickness of the undercoat layer, transmittance of the undercoat layer, volume resistivity of the undercoat layer, a change of the volume resistivity, and a volume rate of the zinc oxide particles occupying the undercoat layer are presented in the following Table 1-3.

The undercoat layer was measured for the film thickness, the transmittance, the volume resistivity, and the volume rate of the zinc oxide particles occupying the undercoat layer as described below.

<Measurement of Film Thickness of Undercoat Layer>

A film thickness of the undercoat layer was measured by an eddy-current coating thickness tester (FISCHER SCOPE MMS, available from Fischer). An average thickness of the undercoat layer was determined by calculating the average value of thicknesses randomly-selected five points.

<Transmittance of Undercoat Layer>

The coating liquid used in each of the Examples and Comparative Examples was used to form a film of the undercoat layer having a film thickness of 20 μm on a glass plate under the same conditions (drying temperature and drying time) as described in each of the Examples and the Comparative Examples. An ultraviolet-visible near infrared spectrophotometer UV-3600 (available from SHIMADZU CORPORATION) was used to measure the formed film of the undercoat layer for transmittance in a range of from a wavelength of 500 nm or more but 800 nm or less.

The lowest value of the transmittances in the aforementioned range is referred to as "transmittance", and is presented in Table 1-3.

<Volume Resistivity of Undercoat Layer>

A gold electrode having a diameter of 6.5 mm and a thickness of 50 nm was formed on the undercoat layer formed in each Example through vacuum deposition.

The gold electrode and the conductive support formed at a temperature of 23° C. and a relative humidity of 55% were coupled to a model 2410 high-voltage source meter (available from KEITHLEY) to apply an electric field to the undercoat layer at a rate of 5 V/μm. Volume resistivity of the undercoat layer was determined by using the applied voltage and the electric current. The volume resistivity of the undercoat layer used in each of the Examples and Comparative Examples is presented in Table 1-3.

<Fluctuation of Volume Resistivity>

Volume resistivity A of the undercoat layer at a temperature of 10° C. and a relative humidity of 15% RH, and volume resistivity B of the undercoat layer at a temperature of 30° C. and a relative humidity of 90% RH were measured by the method for measuring volume resistivity described above. Values of A/B obtained from the volume resistivity A and the volume resistivity B are presented in Table 1-3.

<Calculation of Volume Rate of Zinc Oxide Particles Occupying the Undercoat Layer>

A volume rate of the zinc oxide particles occupying the undercoat layer can be determined based on a weight ratio of solid materials at the time of preparing a coating liquid for undercoat layer (it is necessary to consider that a weight of a surface treating agent and a weight of a curable resin may be reduced through reaction), and a specific gravity of each material. Calculation results of the occupancy volume rates of the zinc oxide particles occupying the undercoat layer of Examples and Comparative Examples are presented in Table 1-3.

TABLE 1-3

| | Film thickness (μm) | Transmittance (%) | Volume resistivity (Ω · cm): 23° C. 55% RH | (A) 10° C. 15% RH | (B) 30° C. 90% RH | A/B | Volume rate of the zinc oxide particles occupying the undercoat layer (%) |
|---|---|---|---|---|---|---|---|
| Example 1-1 | 7 | 61 | $4.2 \times 10^7$ | $1.1 \times 10^7$ | $1.7 \times 10^7$ | 0.7 | 53 |
| Example 1-2 | 15 | 59 | $3.7 \times 10^8$ | $1.1 \times 10^9$ | $4.4 \times 10^8$ | 2.4 | 52 |
| Example 1-3 | 25 | 53 | $4.5 \times 10^8$ | $2.1 \times 10^9$ | $6.2 \times 10^8$ | 3.3 | 52 |
| Example 1-4 | 30 | 50 | $6.5 \times 10^8$ | $3.8 \times 10^9$ | $8.5 \times 10^8$ | 4.5 | 49 |
| Example 1-5 | 20 | 63 | $7.5 \times 10^7$ | $8.6 \times 10^7$ | $4.5 \times 10^7$ | 1.9 | 47 |
| Example 1-6 | 20 | 57 | $2.2 \times 10^8$ | $2.1 \times 10^8$ | $1.5 \times 10^8$ | 1.4 | 46 |
| Example 1-7 | 20 | 58 | $1.1 \times 10^7$ | $3.0 \times 10^6$ | $9.9 \times 10^6$ | 0.3 | 54 |
| Example 1-8 | 20 | 73 | $3.9 \times 10^7$ | $6.9 \times 10^7$ | $1.9 \times 10^7$ | 3.6 | 41 |
| Example 1-9 | 20 | 62 | $3.2 \times 10^7$ | $1.9 \times 10^6$ | $1.9 \times 10^7$ | 0.1 | 54 |
| Example 1-10 | 20 | 66 | $1.8 \times 10^7$ | $7.3 \times 10^7$ | $1.3 \times 10^7$ | 5.8 | 46 |

TABLE 1-3-continued

| | Film thickness (μm) | Transmittance (%) | Volume resistivity (Ω · cm) 23° C. 55% RH | (A) 10° C. 15% RH | (B) 30° C. 90% RH | A/B | Volume rate of the zinc oxide particles occupying the undercoat layer (%) |
|---|---|---|---|---|---|---|---|
| Example 1-11 | 20 | 67 | $2.6 \times 10^8$ | $1.5 \times 10^9$ | $2.0 \times 10^8$ | 7.2 | 43 |
| Example 1-12 | 5 | 63 | $9.5 \times 10^7$ | $1.1 \times 10^8$ | $5.7 \times 10^7$ | 1.9 | 47 |
| Example 1-13 | 35 | 63 | $6.0 \times 10^7$ | $6.8 \times 10^7$ | $3.6 \times 10^7$ | 1.9 | 47 |
| Comparative Example 1-1 | 20 | 53 | $3.9 \times 10^9$ | $3.6 \times 10^{10}$ | $3.5 \times 10^9$ | 10.3 | 49 |
| Comparative Example 1-2 | 20 | 40 | $7.0 \times 10^{10}$ | $7.7 \times 10^{11}$ | $4.9 \times 10^{10}$ | 15.8 | 48 |
| Comparative Example 1-3 | 20 | 47 | $1.5 \times 10^9$ | $5.6 \times 10^{10}$ | $8.8 \times 10^8$ | 12.4 | 46 |

<Property of Photoconductor>

The photoconductors obtained in Examples and Comparative Examples were evaluated for residual potential, environmental fluctuation of the residual potential, and image quality.

Evaluation results are presented in Table 1-4.

Evaluations were performed in the following manner.

<<Evaluation Apparatus>>

A digital copying machine (RICOH PROC900, available from RICOH Company, Ltd.) that had been modified was used. A scorotron charging member (in which a discharge wire having a diameter of 50 μm is formed of a tungsten-molybdenum alloy, and is coated with a gold plate) was used as a charging member. A LD light of 780 nm was used for an image exposing source (image writing through a polygon mirror, resolution: 1,200 dpi). A black toner was used for two-component development. A transfer belt was used as a transfer member. A charge-eliminating lamp was used for charge elimination.

<<Method for Deteriorating Photoconductor>>

A test chart of black (image area ratio: 5%) was continuously output on 50,000 sheets under the following conditions: low-temperature and low-humidity environment (LL) of 10° C. and 15% RH; normal-temperature and normal-humidity environment (MM) of 23° C. and 55% RH; and high-temperature and high-humidity environment (HH) of 27° C. and 80% RH.

<<Evaluation of Electric Property (Residual Potential)>>

A surface potential of a photoconductor was measured before and after deterioration of the photoconductor. A developing unit of an evaluation device was modified and was attached with a potential sensor. The thus-obtained unit was mounted on the evaluation device to measure a potential as described below.

A voltage applied to a wire was −1,800 μA, and a grid voltage was −800 V. A full solid image was printed on 100 sheets of paper (size: A3) in the longitudinal direction, and then the first sheet of paper and the 100th sheet of paper were each measured for a potential (VL) of an exposure part. A surface electrometer (MODEL 344 surface electrometer, available from TREK JAPAN) was used for measurement. An oscilloscope was used to record values obtained by the surface electrometer at 100 signals or more/second to evaluate electric properties based on the following criteria.

[Residual Potential]

A: A potential difference (ΔVL) between a potential of an exposure part of the first sheet of paper and a potential of an exposure part of the 100th sheet of paper under the MM is less than 10 V.

B: A potential difference (ΔVL) between a potential of an exposure part of the first sheet of paper and a potential of an exposure part of the 100th sheet of paper under the MM is 10 V or more but less than 30 V.

C: A potential difference (ΔVL) between a potential of an exposure part of the first sheet of paper and a potential of an exposure part of the 100th sheet of paper under the MM is 30 V or more.

[Environmental Fluctuation]

A: A potential difference (ΔVL) between a potential of an exposure part of the 100th sheet of paper under the LL and a potential of an exposure part of the 100th sheet of paper under the HH is less than 20 V.

B: A potential difference (ΔVL) between a potential of an exposure part of the 100th sheet of paper under the LL and a potential of an exposure part of the 100th sheet of paper under the HH is 20 V or more but less than 60 V.

C: A potential difference (ΔVL) between a potential of an exposure part of the 100th sheet of paper under the LL and a potential of an exposure part of the 100th sheet of paper under the HH is 60 V or more.

<<Evaluation of Image>>

An image was output before and after deterioration of the photoconductor, followed by evaluation of background fog and evaluation of unevenness of image density.

A white background image was continuously output on 5 sheets of gloss coat paper to evaluate the presence of background fog.

A half-tone image was continuously output on 10 sheets to visually observe a degree of unevenness of image density for evaluation.

TABLE 1-4

| | Residual potential ΔVL | | Environmental fluctuation ΔVL | | |
|---|---|---|---|---|---|
| | Before deterioration | After deterioration | Before deterioration | After deterioration | Evaluation results of images |
| Example 1-1 | A | A | A | A | Considerably good |
| Example 1-2 | A | A | A | A | Considerably good |
| Example 1-3 | A | A | A | A | Considerably good |
| Example 1-4 | A | A | A | A | Considerably good |

TABLE 1-4-continued

| | Residual potential ΔVL | | Environmental fluctuation ΔVL | | |
|---|---|---|---|---|---|
| | Before deterioration | After deterioration | Before deterioration | After deterioration | Evaluation results of images |
| Example 1-5 | A | A | A | A | Considerably good |
| Example 1-6 | A | B | A | A | Considerably good |
| Example 1-7 | A | A | A | B | Good |
| Example 1-8 | A | B | A | A | Considerably good |
| Example 1-9 | A | A | A | B | Good |
| Example 1-10 | A | A | A | B | Good |
| Example 1-11 | A | B | A | B | Good |
| Example 1-12 | A | B | A | B | Slight background fog occurs after deterioration |
| Example 1-13 | A | B | B | B | Good |
| Comparative Example 1-1 | A | C | A | C | Good |
| Comparative Example 1-2 | A | C | C | C | Good |
| Comparative Example 1-3 | A | B | A | C | Background fog occurs after deterioration |

(2) Next, Examples where the undercoat layer contains a salicylic acid derivative or a thiol compound will be described hereinafter.

[Preparation of Zinc Oxide Particles]

The aforementioned zinc oxide particles having an average primary particle diameter of 50 nm prepared by the wet method were used.

Zinc oxide particles that were not surface-treated (referred to as zinc oxide A) or zinc oxide particles subjected to surface treatment (referred to as zinc oxide B) were used.

The zinc oxide B that were subjected to surface treatment was prepared as described below.

<Preparation of Surface-Treated Zinc Oxide Particles>

Zinc oxide particles (100 parts) were added to toluene (500 parts), which was stirred and mixed. A silane coupling agent (KB M603, available from Shin-Etsu Chemical Co., Ltd.) (1.25 parts) was added to the resultant mixture, followed by stirring for 2 hours. Then, toluene was removed through reduced-pressure distillation, and the surfaces of the zinc oxide particles were baked at 120° C. for 3 hours to obtain zinc oxide particles surface-treated with the silane coupling agent.

Preparation of Coating Liquid for Undercoat Layer

Preparation Example 2-1

Preparation of Coating Liquid for Undercoat Layer 2-1

The following materials were mixed together and were stirred for 72 hours using zirconia beads having a diameter of 3 mm and a ball-mill to prepare a coating liquid for undercoat layer of Example 1.

| | |
|---|---|
| Binder resin: butyral resin (BM-1, available from SEKISUI CHEMICAL CO., LTD.) | 11.4 parts |
| Binder resin: blocked isocyanate (SUMIDUR 3175, available from Sumitomo Bayer Urethane Co., Ltd.) | 15.2 parts |
| Zinc oxide A | 80 parts |
| Compound containing a thiol group: pentaerythritol tetrakis (3-mercaptobutyrate) (KARENZ MTPE1, available from Showa Denko K.K.) | 1.2 parts |
| Solvent: 2-butanone | 115 parts |

Preparation Example 2-2 to Preparation Example 2-12

Preparation of Coating Liquids for Undercoat Layer 2-2 to 2-12

Coating liquids for undercoat layer 2-2 to 2-12 were prepared in the same manner as in the <preparation of coating liquid for undercoat layer 2-1> of the Preparation Example 2-1 except that the surface-treated zinc oxide 1-1 was changed to each of the surface-treated zinc oxides described in Tables 2-1 and 2-2, and that an amount of each component in the binder resin was changed as described in Tables 2-1 and 2-2.

Tables 2-1 and 2-2 present a kind of the surface-treated zinc oxide in each of the coating liquids for undercoat layer, kinds of the surface treating agents, and an amount of each component in the binder resin.

TABLE 2-1-1

| Coating liquid for undercoat layer | | | | | | | | | | |
|---|---|---|---|---|---|---|---|---|---|---|
| | Zinc oxide | | Salicylic acid derivative or thiol compound | | | | Binder resin | | | |
| Coating liquid No. | Zinc oxide No. | Parts | Salicylic acid derivative | Parts | Thiol compound | Parts | Blocked isocyanate (SUMIDUR 3175) (parts) | Butyral resin (BM-1) dissolving solution (parts) | Solvent 2-butanone (parts) | Stirring time (hr) |
| Coating liquid for undercoat layer 2-1 | Zinc oxide A | 80 | — | — | Pentaerythritol tetrakis (3-mercaptobutyrate) | 1.2 | 15.2 | 11.4 | 115 | 72 |

TABLE 2-1-1-continued

| Coating liquid for undercoat layer | | | | | | | | | | |
|---|---|---|---|---|---|---|---|---|---|---|
| | Zinc oxide | | Salicylic acid derivative or thiol compound | | | | Binder resin | | | |
| Coating liquid No. | Zinc oxide No. | Parts | Salicylic acid derivative | Parts | Thiol compound | Parts | Blocked isocyanate (SUMIDUR 3175) (parts) | Butyral resin (BM-1) dissolving solution (parts) | Solvent 2-butanone (parts) | Stirring time (hr) |
| Coating liquid for undercoat layer 2-2 | Zinc oxide A | 80 | Salicylic acid | 1.2 | — | — | 15.2 | 11.4 | 115 | 96 |
| Coating liquid for undercoat layer 2-3 | Zinc oxide A | 80 | — | — | 3-(triethoxysilyl) propanethiol | 2.0 | 9.1 | 6.9 | 100 | 96 |
| Coating liquid for undercoat layer 2-4 | Zinc oxide A | 80 | — | — | 3-(trimethoxysilyl) propanethiol | 2.5 | 9.1 | 6.9 | 100 | 96 |
| Coating liquid for undercoat layer 2-5 | Zinc oxide A | 80 | — | — | 3-(triethoxysilyl) propanethiol | 2.5 | 13.1 | 9.8 | 110 | 72 |
| Coating liquid for undercoat layer 2-6 | Zinc oxide A | 80 | 3,5-di-tert-butyl salicylic acid hydrate | 2 | — | — | 11.4 | 8.6 | 105 | 96 |

TABLE 2-1-2

| Coating liquid for undercoat layer | | | | | | | | | | |
|---|---|---|---|---|---|---|---|---|---|---|
| | Zinc oxide | | Salicylic acid derivative or thiol compound | | | | Binder resin | | | |
| Coating liquid No. | Zinc oxide No. | Parts | Salicylic acid derivative | Parts | Thiol compound | Parts | Blocked isocyanate (SUMIDUR 3175) (parts) | Butyral resin (BM-1) dissolving solution (parts) | Solvent 2-butanone (parts) | Stirring time (hr) |
| Coating liquid for undercoat layer 2-7 | Zinc oxide A | 80 | — | — | 3-(trimethoxysilyl) propanethiol | 2 | 10.1 | 7.6 | 105 | 72 |
| Coating liquid for undercoat layer 2-8 | Zinc oxide B | 80 | — | — | — | — | 18.0 | 7.6 | 105 | 48 |
| Coating liquid for undercoat layer 2-9 | Zinc oxide A | 80 | — | — | — | — | 11.4 | 8.6 | 105 | 96 |
| Coating liquid for undercoat layer 2-10 | Zinc oxide A | 80 | 3,5-di-tert-butyl salicylic acid hydrate | 1.6 | — | — | 15.2 | 11.4 | 115 | 96 |
| Coating liquid for undercoat layer 2-11 | Zinc oxide A | 80 | — | — | 3-(trimethoxysilyl) propanethiol | 2 | 10.1 | 7.6 | 105 | 120 |
| Coating liquid for undercoat layer 2-12 | Zinc oxide A | 80 | — | — | 3-(triethoxysilyl) propanethiol | 2 | 10.1 | 7.6 | 105 | 120 |

[Coating Liquid for Charge Generating Layer and Coating Liquid for Charge Transport Layer]

The same coating liquid for charge generating layer and the same coating liquid for charge transport layer as used in Example 1-1 were used.

Example 2-1

An aluminium cylinder (diameter: 100 mm, length: 380 mm) was coated with the coating liquid for undercoat layer 2-1 by the dip coating method, and then was dried at 170° C. for 30 minutes to form an undercoat layer having an average thickness of 15 μm. Next, the coating liquid for charge generating layer was coated on the undercoat layer by the dip coating method, and was dried at 90° C. for 30 minutes to form a charge generating layer having an average thickness of 0.2 μm. The coating liquid for charge transport layer was coated on charge generating layer by the dip coating method, and was dried at 130° C. for 30 minutes to form a charge transport having an average thickness of 25 μm. As described above, photoconductor 2-1 of Example 2-1 was prepared.

Example 2-2 to Example 2-7

Photoconductor 2-2 to photoconductor 2-7 of Example 2-2 to Example 2-7 were prepared in the same manner as in Example 2-1 except that the coating liquid for undercoat layer 2-1 was changed to each of the coating liquid for undercoat layer 2-2 to the coating liquid for undercoat layer 2-7.

Comparative Example 2-1 to Comparative Example 2-5

Photoconductor 2-8 to photoconductor 2-12 of Comparative Example 2-1 to Comparative Example 2-5 were prepared in the same manner as in Example 2-1 except that the coating liquid for undercoat layer 2-1 was changed to each of the coating liquid for undercoat layer 2-8 to the coating liquid for undercoat layer 2-12.

Tables 2-2-1, 2-2-2, 2-2-3, and 2-2-4 present kinds of the coating liquids for undercoat layer used in Examples and Comparative Examples and film thicknesses of the undercoat layer.

TABLE 2-2-1

| | | | Coating liquid for undercoat layer | | | | | | | | | | |
|---|---|---|---|---|---|---|---|---|---|---|---|---|---|
| | | | | | | | | | | Binder resin | | | |
| | | Film thickness | | Zinc oxide | | Salicylic acid derivative or thiol compound | | | | Blocked | Butyral resin (BM-1) | |
| | | of under-coating layer (μm) | Coating liquid No. | Zinc oxide No. | Parts | Salicylic acid derivative | Parts | Thiol compound | Parts | isocyanate (SUMIDUR 3175) (parts) | dissolving solution (parts) | Solvent 2-butanone (parts) |
| Ex. 2-1 | Photo-conductor 2-1 | 15 | Coating liquid for under-coating layer 2.1 | Zinc oxide A | 80 | — | — | Pentaerythritol tetrakis (3-mercapto-butyrate) | 1.2 | 15.2 | 11.4 | 115 |
| Ex. 2-2 | Photo-conductor 2-2 | 20 | Coating liquid for under-coating layer 2-2 | Zinc oxide A | 80 | Salicylic acid | 1.2 | — | — | 15.2 | 11.4 | 115 |
| Ex. 2-3 | Photo-conductor 2-3 | 7 | Coating liquid for under-coating layer 2-3 | Zinc oxide A | 80 | — | — | 3-(triethoxysilyl) propanethiol | 2.0 | 9.1 | 6.9 | 100 |

TABLE 2-2-2

| | | | Coating liquid for undercoat layer | | | | | | | | | | |
|---|---|---|---|---|---|---|---|---|---|---|---|---|---|
| | | | | | | | | | | Binder resin | | | |
| | | Film thickness of under- | | Zinc oxide | | Salicylic acid derivative or thiol compound | | | | Blocked | Butyral resin (BM-1) | |
| | | coating layer (μm) | Coating liquid No. | Zinc oxide No. | Parts | Salicylic acid derivative | Parts | Thiol compound | Parts | isocyanate (SUMIDUR 3175) (parts) | dissolving solution (parts) | Solvent 2-butanone (parts) |
| Ex. 2-4 | Photo-conductor 2-4 | 30 | Coating liquid for under-coating layer 2-4 | Zinc oxide A | 80 | — | — | 3-(trimethoxysilyl) propanethiol | 2.5 | 9.1 | 6.9 | 100 |
| Ex. 2-5 | Photo-conductor 2-5 | 20 | Coating liquid for under-coating layer 2-5 | Zinc oxide A | 80 | — | — | 3-(triethoxysily1) propanethiol | 2.5 | 13.1 | 9.8 | 110 |
| Ex. 2-6 | Photo-conductor 2-6 | 18 | Coating liquid for under-coating layer 2-6 | Zinc oxide A | 80 | 3,5-di-tert-butyl salicylic acid hydrate | 2 | — | — | 11.4 | 8.6 | 105 |

TABLE 2-2-3

| | | Film thickness of under-coating layer (μm) | Coating liquid for undercoat layer: Coating liquid No. | Zinc oxide: Zinc oxide No. | Zinc oxide: Parts | Salicylic acid derivative or thiol compound: Salicylic acid derivative | Parts | Thiol compound | Parts | Binder resin: Blocked isocyanate (SUMIDUR 3175) (parts) | Binder resin: Butyral resin (BM-1) dissolving solution (parts) | Solvent 2-butanone (parts) |
|---|---|---|---|---|---|---|---|---|---|---|---|---|
| Ex. 2-7 | Photo-conductor 2-7 | 23 | Coating liquid for under-coating layer 2-7 | Zinc oxide A | 80 | — | — | 3-(trimethoxysilyl) propanethiol | 2 | 10.1 | 7.6 | 105 |
| Comp. Ex. 2-1 | Photo-conductor 2-8 | 20 | Coating liquid for under-coating layer 2-8 | Zinc oxide A | 80 | — | — | — | — | 18.0 | 7.6 | 105 |
| Comp. Ex. 2-2 | Photo-conductor 2-9 | 8 | Coating liquid for under-coating layer 2-9 | Zinc oxide A | 80 | — | — | — | — | 11.4 | 8.6 | 105 |

TABLE 2-2-4

| | | Film thickness of under-coating layer (μm) | Coating liquid for undercoat layer: Coating liquid No. | Zinc oxide: Zinc oxide No. | Zinc oxide: Parts | Salicylic acid derivative or thiol compound: Salicylic acid derivative | Parts | Thiol compound | Parts | Binder resin: Blocked isocyanate (SUMIDUR 3175) (parts) | Binder resin: Butyral resin (BM-1) dissolving solution (parts) | Solvent 2-butanone (parts) |
|---|---|---|---|---|---|---|---|---|---|---|---|---|
| Comp. Ex. 2-3 | Photo-conductor 2-10 | 18 | Coating liquid for under-coating layer 2-10 | Zinc oxide A | 80 | 3,5-di-tert-butyl salicylic acid hydrate | 1.6 | — | — | 15.2 | 11.4 | 115 |
| Comp. Ex. 2-4 | Photo-conductor 2-11 | 5 | Coating liquid for under-coating layer 2-11 | Zinc oxide A | 80 | — | — | 3-(trimethoxysilyl) propanethiol | 2 | 10.1 | 7.6 | 105 |
| Comp. Ex. 2-5 | Photo-conductor 2-12 | 5 | Coating liquid for under-coating layer 2-12 | Zinc oxide A | 80 | — | — | 3-(triethoxysily1) propanethiol | 2 | 10.1 | 7.6 | 105 |

A film thickness of the undercoat layer, transmittance of the undercoat layer, volume resistivity of the undercoat layer, a change of the volume resistivity, and a volume rate of the zinc oxide particles occupying the undercoat layer were evaluated in the same evaluation methods as in Example 1-1.

Evaluation results are presented in Table 2-3.

TABLE 2-3

| | Film thickness of undercoat layer (μm) | Trans-mittance (%) | Volume resistivity (Ω · cm): 23° C. 55% RH | (A) 10° C. 15% RH | (B) 30° C. 90% RH | A/B | volume rate of the zinc oxide particles occupying the undercoat layer |
|---|---|---|---|---|---|---|---|
| Example 2-1 | 15 | 67 | $2.2 \times 10^7$ | $4.8 \times 10^7$ | $9.4 \times 10^6$ | 5.1 | 43.2 |
| Example 2-2 | 20 | 63 | $1.7 \times 10^8$ | $9.5 \times 10^7$ | $5.0 \times 10^8$ | 0.2 | 44.6 |
| Example 2-3 | 7 | 73 | $1.8 \times 10^7$ | $7.0 \times 10^7$ | $1.1 \times 10^7$ | 6.4 | 55.6 |

TABLE 2-3-continued

| | Film thickness of undercoat layer (μm) | Trans-mittance (%) | Volume resistivity (Ω · cm) 23° C. 55% RH | (A) 10° C. 15% RH | (B) 30° C. 90% RH | A/B | volume rate of the zinc oxide particles occupying the undercoat layer |
|---|---|---|---|---|---|---|---|
| Example 2-4 | 30 | 80 | $4.6 \times 10^8$ | $7.5 \times 10^8$ | $4.4 \times 10^8$ | 1.7 | 53.9 |
| Example 2-5 | 20 | 70 | $1.4 \times 10^8$ | $2.5 \times 10^8$ | $9.4 \times 10^7$ | 2.7 | 46.3 |
| Example 2-6 | 18 | 75 | $1.2 \times 10^7$ | $3.5 \times 10^7$ | $9.7 \times 10^6$ | 3.6 | 50.7 |
| Example 2-7 | 23 | 71 | $8.5 \times 10^7$ | $1.1 \times 10^8$ | $7.4 \times 10^7$ | 1.5 | 52.6 |
| Comparative Example 2-1 | 20 | 48 | $4.4 \times 10^8$ | $2.1 \times 10^9$ | $6.7 \times 10^7$ | 31.3 | 46.7 |
| Comparative Example 2-2 | 8 | 74 | $5.2 \times 10^8$ | $1.8 \times 10^9$ | $8.3 \times 10^7$ | 21.7 | 53.3 |
| Comparative Example 2-3 | 18 | 64 | $9.3 \times 10^6$ | $2.7 \times 10^6$ | $4.3 \times 10^6$ | 0.6 | 44.2 |
| Comparative Example 2-4 | 5 | 83 | $3.3 \times 10^8$ | $7.5 \times 10^8$ | $1.4 \times 10^8$ | 5.4 | 52.6 |
| Comparative Example 2-5 | 32 | 82 | $2.3 \times 10^8$ | $4.2 \times 10^8$ | $9.3 \times 10^7$ | 4.5 | 49.9 |

<Property of Photoconductor>

The photoconductors obtained in Examples 2-1 to 2-7 and Comparative Examples 2-1 to 2-5 were evaluated for residual potential, environmental fluctuation of residual potential, and an image.

Evaluation results are presented in Tables 2-4-1 and 2-4-2.

Evaluations were performed in the following manners.

<<Evaluation Apparatus>>

A digital copying machine (RICOH PROC900, available from RICOH Company, Ltd.) that had been modified was used. A scorotron charging member (in which a discharge wire having a diameter of 50 μm is formed of a tungsten-molybdenum alloy, and is coated with a gold plate) was used as a charging member. A LD light of 780 nm was used for an image exposure source (image writing through a polygon mirror, resolution: 1,200 dpi). A black toner was used for two-component development. A transfer belt was used as a transfer member. A charge-eliminating lamp was used for charge elimination.

<<Method for Deteriorating Photoconductor>>

A test chart of black (image area ratio: 5%) was continuously output on 20,000 sheets under the following conditions: temperature of 23° C. and humidity of 55% RH.

[Image Evaluation]

An image was output before and after deterioration of the photoconductor under the following conditions: temperature of 23° C. and relative humidity of 55% RH; temperature of 10° C. and relative humidity of 15% RH; and temperature of 27° C. and relative humidity of 80% RH, followed by evaluation of background fog and evaluation of unevenness of image density.

A white background image was continuously output on 5 sheets of gloss coat paper to evaluate the presence of background fog.

A half-tone image was continuously output on 100 sheets of paper to visually observe unevenness of image density on the first sheet of paper and unevenness of image density on the 100th sheet of paper for evaluation.

Evaluation results of background fog and unevenness of image density are presented in Tables 2-4-1 and 2-4-2.

[Evaluation Criteria]

Background fog: Randomly-selected ten portions (8 mm×11 mm) on the gloss coat paper that had been output were counted for the number of visually found background fogs, and then an average of the number of the background fogs was calculated.

A: 10 or less

B: more than 10 but 20 or less

C: more than 20 but 50 or less

D: More than 50

Unevenness of image density: After 100 sheets of paper were output, unevenness of image density on the first sheet of paper and unevenness of image density on the 100th sheet of paper were visually evaluated.

A: Unevenness of image density is not found.

B: Considerably slight unevenness of image density is found.

C: Slight unevenness of image density is found.

D: Unevenness of image density is clearly found.

TABLE 2-4-1

| | Before fatigue | | | | | | After fatigue | | | | | |
|---|---|---|---|---|---|---|---|---|---|---|---|---|
| | 23° C. 55% RH | | 10° C. 15% RH | | 30° C. 90% RH | | 23° C. 55% RH | | 10° C. 15% RH | | 30° C. 90% RH | |
| | Back-ground fog | Image density | Back-ground fog | Image density | Back-ground fog | Image density | Back-ground fog | Image density | Back-ground fog | Image density | Back-ground fog | Image density |
| Ex. 2-1 | A | B | A | B | A | A | B | B | B | B | B | B |
| Ex. 2.2 | A | B | A | B | A | A | A | B | A | B | B | B |
| Ex. 2-3 | A | A | A | A | B | B | B | B | B | B | B | B |
| Ex. 2-4 | A | B | A | A | A | B | A | B | A | B | A | B |

TABLE 2-4-1-continued

| | Before fatigue | | | | | | After fatigue | | | | | |
|---|---|---|---|---|---|---|---|---|---|---|---|---|
| | 23° C. 55% RH | | 10° C. 15% RH | | 30° C. 90% RH | | 23° C. 55% RH | | 10° C. 15% RH | | 30° C. 90% RH | |
| | Back-ground fog | Image density | Back-ground fog | Image density | Back-ground fog | Image density | Back-ground fog | Image density | Back-ground fog | Image density | Back-ground fog | Image density |
| Ex. 2.5 | A | A | A | B | A | B | A | B | A | B | A | B |
| Ex. 2-6 | A | A | A | A | A | A | A | B | A | A | A | A |
| Ex. 2-7 | A | A | A | A | A | A | A | A | A | A | A | A |

TABLE 2-4-2

| | Before fatigue | | | | | | After fatigue | | | | | |
|---|---|---|---|---|---|---|---|---|---|---|---|---|
| | 23° C. 55% RH | | 10° C. 15% RH | | 30° C. 90% RH | | 23° C. 55% RH | | 10° C. 15% RH | | 30° C. 90% RH | |
| | Back-ground fog | Image density | Back-ground fog | Image density | Back-ground fog | Image density | Back-ground fog | Image density | Back-ground fog | Image density | Back-ground fog | Image density |
| Comp. Ex. 2-1 | A | B | B | B | B | B | B | D | B | D | D | D |
| Comp. Ex. 2-2 | B | B | C | C | C | C | D | D | D | D | D | D |
| Comp. Ex. 2-3 | C | A | C | B | C | B | D | C | D | C | D | C |
| Comp. Ex. 2-4 | C | A | C | B | C | B | D | C | D | C | D | C |
| Comp. Ex. 2.5 | A | C | B | C | B | C | C | D | C | D | C | D |

Embodiments of the present invention are as follows, for example.

<1>. A photoconductor including:

a conductive support;

an undercoat layer; and a photoconductive layer, the undercoat layer being disposed over the conductive support, the photoconductive layer being disposed over the undercoat layer, wherein the undercoat layer includes zinc oxide particles, wherein when a film thickness of the undercoat layer is 20 μm, the undercoat layer has transmittance of 50% or more to light having a wavelength in a range of 500 nm or more but 800 nm or less, wherein a lowest transmittance of light is 85% or less in the range, and wherein when an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

<2> The photoconductor according to <1>, wherein the zinc oxide particles are zinc oxide particles surface-treated with alkylalkoxysilane, and at least one alkyl group bound to Si in the alkylalkoxysilane includes at least one alkyl group having 4 or less carbon atoms.

<3> The photoconductor according to <2>, wherein an amount of a surface treating agent used for surface-treating the zinc oxide particles is 1.5% by mass or more but 4.0% by mass or less relative to an amount of the zinc oxide particles before surface treatment.

<4> The photoconductor according to any one of <1> to <3>, wherein the undercoat layer contains a salicylic acid derivative or a thiol compound.

<5> The photoconductor according to any one of <1> to <4>, wherein an average film thickness of the undercoat layer is 7 μm or more but 30 μm or less.

<6> The photoconductor according to any one of <1> to <5>, wherein the undercoat layer satisfies a relational expression (1) below:

$$0.2<A/B<5 \quad (1),$$

where A is volume resistivity of the undercoat layer when an electric field of 5 V/μm is applied to the undercoat layer at a temperature of 10° C. and a relative humidity of 15% RH, and B is volume resistivity of the undercoat layer when an electric field of 5 V/μm is applied to the undercoat layer at a temperature of 30° C. and a relative humidity of 90% RH.

<7> The photoconductor according to any one of <1> to <6>, wherein a volume rate of the zinc oxide particles occupying the undercoat layer is 45% or more but 53% or less of the undercoat layer.

<8> An image forming apparatus including:

a photoconductor;

a charging unit configured to charge a surface of the photoconductor;

an exposing unit configured to expose the surface of the photoconductor charged to form an electrostatic latent image;

a developing unit configured to develop the electrostatic latent image with a toner to form a visible image; and a transfer unit configured to transfer the visible image onto a recording medium, wherein the photoconductor is the photoconductor according to any one of <1> to <7>.

<9> A process cartridge including:

a photoconductor; and at least one unit selected from the group consisting of a charging unit, an exposing unit, a developing unit, and a transfer unit, wherein the charging unit is configured to charge a surface of the photoconductor, the exposing unit is configured to expose the surface of the photoconductor charged to form an electrostatic latent image, the developing unit is configured to develop the electrostatic latent image with a toner to form a visible image, and the transfer unit is configured to transfer the visible image onto a recording medium, and wherein the photoconductor is the photoconductor according to any one of <1> to <7>.

What is claimed is:

1. A photoconductor, comprising:

a conductive support;

an undercoat layer, and a photoconductive layer, wherein the undercoat layer is disposed over the conductive support and the photoconductive layer is disposed over the undercoat layer, wherein the undercoat layer comprises zinc oxide particles and a salicylic acid derivative or a thiol compound, wherein when a film thickness of the undercoat layer is 20 μm, the undercoat layer has transmittance of 50% or more to light having a wavelength in a range of 500 nm or more but 800 nm or less, wherein a lowest transmittance of light is 50% or more but 85% or less in the range, and wherein when an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

2. The photoconductor according to claim 1, wherein the zinc oxide particles are zinc oxide particles surface-treated with alkylalkoxysilane, and at least one alkyl group bound to Si in the alkylalkoxysilane comprises at least one alkyl group having 4 or less carbon atoms.

3. The photoconductor according to claim 2, wherein an amount of a surface treating agent used for surface-treating the zinc oxide particles is 1.5% by mass or more but 4.0% by mass or less relative to an amount of the zinc oxide particles before surface treatment.

4. The photoconductor according to claim 1, wherein an average film thickness of the undercoat layer is 7 μm or more but 30 μm or less.

5. The photoconductor according to claim 1, wherein the undercoat layer satisfies a relational expression (1) below:

$$0.2<A/B<5 \quad (1),$$

where A is volume resistivity of the undercoat layer when an electric field of 5 V/μm is applied to the undercoat layer at a temperature of 10° C. and a relative humidity of 15% RH, and B is volume resistivity of the undercoat layer when an electric field of 5 V/μm is applied to the undercoat layer at a temperature of 30° C. and a relative humidity of 90% RH.

6. The photoconductor according to claim 1, wherein a volume rate of the zinc oxide particles occupying the undercoat layer is 45% or more but 53% or less of the undercoat layer.

7. An image forming apparatus, comprising:

a photoconductor;

a charging unit configured to charge a surface of the photoconductor;

an exposing unit configured to expose the surface of the photoconductor charged to light to form an electrostatic latent image;

a developing unit configured to develop the electrostatic latent image with a toner to form a visible image; and a transfer unit configured to transfer the visible image onto a recording medium, wherein the photoconductor comprises:

a conductive support;

an undercoat layer; and a photoconductive layer, wherein the undercoat layer is disposed over the conductive support and the photoconductive layer is disposed over the undercoat layer, wherein the undercoat layer contains zinc oxide particles and a salicylic acid derivative or a thiol compound, wherein when a film thickness of the undercoat layer is 20 μm, the undercoat layer has transmittance of 50% or more to light having a wavelength in a range of 500 nm or more but 800 nm or less, wherein a lowest transmittance of light is 50% or more but 85% or less in the range, and wherein when an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

8. The image forming apparatus according to claim 7, wherein the zinc oxide particles are zinc oxide particles surface-treated with alkylalkoxysilane, and at least one alkyl group bound to Si in the alkylalkoxysilane comprises at least one alkyl group having 4 or less carbon atoms.

9. The image forming apparatus according to claim 8, wherein an amount of a surface treating agent used for surface-treating the zinc oxide particles is 1.5% by mass or more but 4.0% by mass or less relative to an amount of the zinc oxide particles before surface treatment.

10. The image forming apparatus according to claim 7, wherein an average film thickness of the undercoat layer is 7 μm or more but 30 μm or less.

11. The image forming apparatus according to claim 7, wherein the undercoat layer satisfies a relational expression (1) below:

$$0.2<A/B<5 \quad (1),$$

where A is volume resistivity of the undercoat layer when an electric field of 5 V/μm is applied to the undercoat layer at a temperature of 10° C. and a relative humidity of 15% RH, and B is volume resistivity of the undercoat layer when an electric field of 5 V/μm is applied to the undercoat layer at a temperature of 30° C. and a relative humidity of 90% RH.

12. A process cartridge, comprising:

a photoconductor; and at least one unit selected from the group consisting of a charging unit, an exposing unit, a developing unit, and a transfer unit, wherein the charging unit is configured to charge a surface of the photoconductor, the exposing unit is configured to expose the surface of the photoconductor charged to form an electrostatic latent image, the developing unit is configured to develop the electrostatic latent image with a toner to form a visible image, and the transfer unit is configured to transfer the visible image onto a recording medium, wherein the photoconductor comprises:

a conductive support;

an undercoat layer; and a photoconductive layer, wherein the undercoat layer is disposed over the conductive support and the photoconductive layer is disposed over the undercoat layer, wherein the undercoat layer comprises zinc oxide particles and a salicylic acid derivative or a thiol compound, wherein when a film thickness of the undercoat layer is 20 μm, the undercoat layer has transmittance of 50% or more to light having a wavelength in a range of 500 nm or more but 800 nm or less, wherein a lowest transmittance of light is 50% or more but 85% or less in the range, and wherein when an electric field of 5 V/μm is applied to the undercoat layer, volume resistivity of the undercoat layer is $1.0\times10^{7}$ Ω·cm or more but $5.0\times10^{8}$ Ω·cm or less at an environment of 23° C. and 55% RH.

13. The process cartridge according to claim 12, wherein the zinc oxide particles are zinc oxide particles surface-treated with alkylalkoxysilane, and at least one alkyl group bound to Si in the alkylalkoxysilane comprises at least one alkyl group having 4 or less carbon atoms.

14. The process cartridge according to claim 13, wherein an amount of a surface treating agent used for surface-treating the zinc oxide particles is 1.5% by mass or more but 4.0% by mass or less relative to an amount of the zinc oxide particles before surface treatment.

15. The process cartridge according to claim 12, wherein an average film thickness of the undercoat layer is 7 μm or more but 30 μm or less.

16. The process cartridge according to claim 12, wherein the undercoat layer satisfies a relational expression (1) below:

$$0.2<A/B<5 \quad (1),$$

where A is volume resistivity of the undercoat layer when an electric field of 5 V/μm is applied to the undercoat layer at a temperature of 10° C. and a relative humidity of 15% RH, and B is volume resistivity of the undercoat layer when an electric field of 5 V/μm is applied to the undercoat layer at a temperature of 30° C. and a relative humidity of 90% RH.

* * * * *